US012607389B2

(12) United States Patent
Gao et al.

(10) Patent No.: US 12,607,389 B2
(45) Date of Patent: Apr. 21, 2026

(54) MULTI-ENERGY COUPLED COOLING/HEATING SYSTEM FOR BUILDINGS IN LONG-TERM COOLING REGION AND OPERATION METHOD

(71) Applicant: NORTH CHINA MUNICIPAL ENGINEERING DESIGN & RESEARCH INSTITUTE CO., LTD., Tianjin (CN)

(72) Inventors: Wenxue Gao, Tianjin (CN); Mingchang Yang, Tianjin (CN); Yan Wang, Tianjin (CN); Lin Yang, Tianjin (CN); Rongsong Yan, Tianjin (CN); Yingjie Hu, Tianjin (CN); Qingwei Miao, Tianjin (CN)

(73) Assignee: NORTH CHINA MUNICIPAL ENGINEERING DESIGN & RESEARCH INSTITUTE CO., LTD., Tianjin (CN)

( * ) Notice: Subject to any disclaimer, the term of this patent is extended or adjusted under 35 U.S.C. 154(b) by 0 days.

(21) Appl. No.: 18/986,989

(22) Filed: Dec. 19, 2024

(65) Prior Publication Data

US 2025/0116436 A1 Apr. 10, 2025

Related U.S. Application Data

(63) Continuation of application No. PCT/CN2024/099168, filed on Jun. 14, 2024.

(30) Foreign Application Priority Data

Jun. 29, 2023 (CN) ..... 202310781820.8

(51) Int. Cl.
*F25B 15/06* (2006.01)
*F24D 3/08* (2006.01)
(Continued)

(52) U.S. Cl.
CPC ..... *F25B 15/06* (2013.01); *F24D 3/08* (2013.01); *F24D 12/02* (2013.01);
(Continued)

(58) Field of Classification Search
CPC .... F25B 15/06; F25B 27/007; F24D 19/1078; F24D 2200/11; F24F 5/0014
See application file for complete search history.

(56) References Cited

FOREIGN PATENT DOCUMENTS

CN 107328003 A 11/2017
CN 110260396 A * 9/2019 ..... F24D 17/0021
(Continued)

*Primary Examiner* — Jerry-Daryl Fletcher
*Assistant Examiner* — Keith Stanley Myers

(57) ABSTRACT

A multi-energy coupled cooling/heating system, including a multi-level management unit for heat sources, a solar energy heat collection unit, a lithium bromide absorptive refrigeration unit, a gas heat complementing unit, a ground source heat pump cooling/heating unit, and an indirect evaporative cooling waste heat recovery unit; the multi-level management unit for heat sources is connected to the solar energy heat collection unit, the lithium bromide absorptive refrigeration unit, the gas heat complementing unit, and the ground source heat pump cooling/heating unit, the ground source heat pump cooling/heating unit is connected to the indirect evaporative cooling waste heat recovery unit.

7 Claims, 3 Drawing Sheets

(51) Int. Cl.

| | |
|---|---|
| ***F24D 11/02*** | (2006.01) |
| ***F24D 12/02*** | (2006.01) |
| ***F24D 19/10*** | (2006.01) |
| ***F25B 27/00*** | (2006.01) |
| ***F25B 41/28*** | (2021.01) |
| ***F25B 49/04*** | (2006.01) |

(52) U.S. Cl.
CPC ..... *F24D 19/1078* (2013.01); *F25B 27/007* (2013.01); *F25B 41/28* (2021.01); *F25B 49/043* (2013.01); *F24D 11/02* (2013.01); *F24D 2200/11* (2013.01); *F25B 2315/007* (2013.01)

(56) References Cited

FOREIGN PATENT DOCUMENTS

| | | | | |
|---|---|---|---|---|
| CN | 211011985 | U | | 7/2020 |
| CN | 215863654 | U | | 2/2022 |
| CN | 116642229 | A | | 8/2023 |
| JP | 2004012025 | A | * | 1/2004 |
| KR | 20180109110 | A | | 10/2018 |
| WO | 2015049288 | A1 | | 4/2015 |

* cited by examiner

MULTI-ENERGY COUPLED COOLING/HEATING SYSTEM FOR BUILDINGS IN LONG-TERM COOLING REGION AND OPERATION METHOD

CROSS-REFERENCE TO RELATED APPLICATIONS

This application is a bypass continuation application of PCT application no.: PCT/CN2024/099168. This application claims priorities from PCT Application PCT/CN2024/099168, filed Jun. 14, 2024, and from Chinese patent application 2023107818208, filed Jun. 29, 2023, the contents of which are incorporated herein in the entirety by reference.

TECHNICAL FIELD

The present disclosure belongs to the field of cleaning application engineering of renewable energy such as solar energy and shallow geothermal energy, and in particular to a multi-energy coupled cooling/heating system for buildings in a long-term cooling region and an operation method.

BACKGROUND ART

Summer is hot and humid in Southern China, resulting in a long cooling season and a high demand for cooling capacity in buildings, while winter temperatures are not as low as a temperature in Northern China, a high humidity makes people feel distinctly 'damp and cold'. In southern buildings, the demand for cooling/heating is imbalanced throughout the year. Relying on a single energy source for heating and cooling in buildings can lead to issues such as excessive energy consumption, increased environmental pressure, and inefficient system configurations. To address these issues, a solution that integrates a plurality of energy sources and collaboratively utilizes various technologies for energy supply has been proposed. In this solution, various renewable and low-carbon clean energy sources are fully used, and multi-energy coupled and complementary utilization are implemented, which breaks the limitations of single energy applications and enhances the stability of an energy supply system.

For example, the disclosure of the Chinese patent with publication number: CN 110701667B provides a composite energy supply system using solar energy and a ground source heat pump, and an operation method for the system. Anew energy supply system is built based on ground source heat pump technology and heat storage technology, and solar energy and shallow geothermal resources are fully used, while an operation mode of the system is adjusted to meet heating demands at different temperature levels for both residential and industrial use. However, this system can only meet the heating demands of buildings and cannot provide cooling, making it unsuitable for residential buildings in the southern region.

The disclosure of the Chineses patent with publication number CN 115127165A provides an electric heat dual storage energy supply system with solar energy coupled with a ground source heat pump. In the system, the ground source heat pump is used as a complementing heat source in a severe cold period in winter and a cooling source in summer, the electricity generated by photovoltaic panels is pre-stored in batteries, and an active and passive coupling mode combining phase change materials and liquid cooling collects unfavorable heat generated in the photovoltaic panels and the batteries, and the unfavorable heat is stored in a thermal insulation energy storage device, which is used for building heating in winter and soil heat complementing in summer. However, the disclosure achieves a balance between cooling and heat in soil by complementing heat energy through an energy storage device, making it suitable only for buildings where a heat load exceeds a cooling load. In addition, the system operates normally by relying on batteries and the phase change materials for energy storage, causing an application scope of the system to be limited to small buildings and standalone villas. The energy supply system of the disclosure lacks stable energy supply measures for the energy, and excessive energy storage and accumulation steps significantly increase a system's failure rate and operational maintenance costs, resulting in poor economic viability.

The disclosure of the Chinese patent with publication number CN 115435415A provides a combined heating and cooling system using geothermal energy and air energy. The system provides two energy sources and makes the best of respective advantages, to ensure stable energy supply for buildings. However, the system does not consider the influence of extreme climates. In severe cold or hot climates, the energy supply efficiency of an air energy heat pump is obviously affected by the outdoor air, heat and cooling imbalance of a ground source heat pump is also particularly significant, and the simple combination cannot easily ensure the energy satisfaction of users.

In a multi-energy coupled and complementary utilization energy supply system, a simple energy combination application can lead to low thermal efficiency and great heat loss. In the system, heat management is performed for different energy sources based on quality and characteristics, which can effectively improve thermal efficiency and reduce exergy loss of the system. For example, the disclosure of the Chinese patent with publication number CN 110260396B provides a solar energy and ground source heat pump coupled hot water heating and cooling system based on layered thermal management. By utilizing a temperature stratification principle of a heat storage tank, the system controls temperature levels at various nodes within the tank. The system adopts a top-outlet and bottom-inlet approach for the heat storage tank, achieving efficient utilization of solar energy, ground source heat pump, and electric heat complementing. The system of the disclosure has a low load and is suitable only for residential heating applications.

The above disclosures apply only to buildings in the northern region where a heat load is greater than a cooling load, and only the stability of energy supply is considered for heating. Currently, for buildings in the southern region with a high demand for cooling for a long period, no ideal solution for an energy supply system has been proposed.

SUMMARY OF THE DISCLOSURE

The present disclosure is intended to overcome shortcomings in the prior art and provide a stable, efficient, comfortable, energy-saving, and economical multi-energy coupled cooling/heating system for buildings in a long-term cooling region and an operation method that can satisfy heating, domestic hot water supply, and cooling demands of buildings.

To achieve the foregoing objective, a system combination form of the present disclosure is presented as follows.

The multi-energy coupled cooling/heating system for buildings in a long-term cooling region includes a multi-level management unit for heat sources, a solar energy heat collection unit, a lithium bromide absorptive refrigeration unit, a gas heat complementing unit, a ground source heat pump cooling/heating unit, and an indirect evaporative cooling waste heat recovery unit. The multi-level management unit for heat sources is respectively connected to the solar energy heat collection unit, the lithium bromide absorptive refrigeration unit, the gas heat complementing unit, and the ground source heat pump cooling/heating unit. The ground source heat pump cooling/heating unit is respectively connected to the lithium bromide absorptive refrigeration unit, the gas heat complementing unit, and the indirect evaporative cooling waste heat recovery unit.

The lithium bromide absorptive refrigeration unit includes a first refrigeration unit heat exchanger. A first shell side outlet of the first refrigeration unit heat exchanger is successively connected to a shell side inlet of a second refrigeration unit heat exchanger, a shell side outlet of the second refrigeration unit heat exchanger, a first throttle valve, a shell side inlet of a third refrigeration unit heat exchanger, a shell side outlet of the third refrigeration unit heat exchanger, a shell side inlet of a fourth refrigeration unit heat exchanger, a shell side outlet of the fourth refrigeration unit heat exchanger, a first solution pump, and a shell side inlet of the first refrigeration unit heat exchanger through refrigeration circulation pipelines. A second outlet of the first refrigeration unit heat exchanger is connected to a second shell side inlet of the fourth refrigeration unit heat exchanger through a backflow pipeline provided with a throttle valve. The first refrigeration unit heat exchanger, the second refrigeration unit heat exchanger, the third refrigeration unit heat exchanger, and the fourth refrigeration unit heat exchanger are connected in series to form an annular lithium bromide absorptive refrigeration unit. An outlet of a fan coil unit is successively connected to a first tube side inlet of a ground source heat pump heat exchanger, a first tube side outlet of the ground source heat pump heat exchanger, a tenth valve, a fifth water pump, a fourteenth valve, a sixteenth valve, and an inlet of the fan coil unit through fan coil unit heat exchange circulation pipelines. An inlet of a first connecting pipeline installed with a ninth valve communicates with fan coil unit heat exchange circulation pipelines between a first tube side outlet of the ground source heat pump heat exchanger and the tenth valve, and an outlet of the first connecting pipeline is connected to a tube side inlet of the third refrigeration unit heat exchanger. An inlet of a second connecting pipeline is connected to a tube side outlet of the third refrigeration unit heat exchanger, and an outlet of the second connecting pipeline communicates with fan coil unit heat exchange circulation pipelines between the tenth valve and the fifth water pump.

The ground source heat pump cooling/heating unit includes a second tube side outlet of the first ground source heat pump heat exchanger, a compressor, a first tube side inlet of a second ground source heat pump heat exchanger, a first tube side outlet of the second ground source heat pump heat exchanger, a second throttle valve, and a second tube side inlet of the first ground source heat pump heat exchanger that are sequentially connected through soil source circulation pipelines. The first ground source heat pump exchanger, the compressor, the second ground source heat pump heat exchanger, and the second throttle valve are connected in series to form an annular ground source heat pump unit. A second shell side outlet of the second ground source heat pump heat exchanger is successively connected to a sixth water pump, a seventh valve, an inlet of a buried pipe heat exchanger, an outlet of the buried pipe heat exchanger, an eighth valve, and a second shell side inlet of the second ground source heat pump heat exchanger through heat pump heat exchange circulation pipelines.

One end of a third connecting pipeline is connected to an inlet of a fresh air heat exchanger, and the other end communicates with a fan coil unit heat exchange circulation pipeline between a fourteenth valve and a sixteenth valve. One end of a fourth connecting pipeline is connected to an outlet of the fresh air heat exchanger, and the other end communicates with fan coil unit heat exchange circulation pipelines between a first tube side inlet of the first ground source heat pump heat exchanger and an outlet of a fan coil unit.

The gas heat complementing unit includes a gas-fired heating and hot water combi-boiler, and the multi-level management unit for heat sources includes a heating water storage tank. A heat complementing hot water outlet of the heating water storage tank is successively connected to a seventh water pump, a twelfth valve, a heating inlet of the gas-fired heating and hot water combi-boiler, a heating outlet of the gas-fired heating and hot water combi-boiler, a fifteenth valve, an eleventh valve, and a heat complementing hot water inlet of the heating water storage tank through heat complementing circulation pipelines. One end of a fifth connecting pipeline communicates with heat complementing circulation pipelines between a fourteenth valve and the eleventh valve, and the other end communicates with fan coil unit heat exchange circulation pipelines between a fifteenth valve and a sixteenth valve. One end of a sixth connecting pipeline installed with a thirteenth valve communicates with fan coil unit heat exchange circulation pipelines between the fourteenth valve and a fifth water pump, and the other end communicates with heat complementing circulation pipelines between a twelfth valve and the heating inlet of the gas-fired heating and hot water combi-boiler.

The indirect evaporative cooling waste heat recovery unit includes an indirect evaporative cooler and a cooling complementing heat exchanger. A wet channel outlet of the indirect evaporative cooler is successively connected to an inlet of a refrigeration side pipeline of the cooling complementing heat exchanger, an outlet of the refrigeration side pipeline, an eighth water pump, and a wet channel inlet of the indirect evaporative cooler through a cooling circulation pipeline. An inlet of a cooling taking side pipeline of the cooling complementing heat exchanger communicates with fan coil unit heat exchange circulation pipelines between the fifth water pump and the fourteenth valve through a seventh connecting pipeline installed with an eighteenth valve, and an outlet of the cooling taking side pipeline of the cooling complementing heat exchanger communicates with a fan coil unit heat exchange circulation pipeline between a first tube side inlet of the first ground source heat pump heat exchanger and an outlet of a fan coil unit through an eighth connecting pipeline installed with a nineteenth valve. A dry channel inlet of the indirect evaporative cooler communicates with outdoor fresh air, and a dry channel outlet is connected to an air inlet of the fresh air heat exchanger.

The multi-level management unit for heat sources includes a heat collection tank and the heating water storage tank. An upper circulating water outlet at the top of the heat collection tank is successively connected to a second water pump, a second electromagnetic valve, and a lower circulating water inlet at the bottom of the heating water storage tank through a ninth connecting pipeline. A lower circulating water outlet at the bottom of the heating water storage tank is connected to the first electromagnetic valve and an upper circulating water inlet at the top of the heat collection tank through a tenth connecting pipeline. An outlet of a first heat taking coil unit installed in the middle of the heating water storage tank is connected to a domestic water end.

The solar energy heat collection unit includes a solar energy heat collector and an upper heat collection coil unit at an inner top of the heat collection tank, and an outlet of the solar energy heat collector is connected to an inlet of the heat collection coil unit. After heat exchange with hot water stored in the heat collection tank, an outlet of the heat collection coil unit is connected to an inlet of the solar energy heat collector through a first water pump, and a lower heat collection coil unit is disposed below the inside of the heat collection tank.

A connection structure of the lithium bromide absorptive refrigeration unit and the multi-level management unit for heat sources is described as follows: a hot water outlet at a lower part of the heat collection tank is successively connected to a fourth water pump, a third valve, and a tube side inlet of a fourth refrigeration unit heat exchanger through an eleventh connecting pipeline. A tube side outlet of the fourth refrigeration unit heat exchanger is connected to a tube side inlet of a second refrigeration unit heat exchanger, a tube side outlet of the second refrigeration unit heat exchanger, the fourth valve, and a hot water inlet at a lower part of the heat collection tank. A tube side outlet of the first refrigeration unit heat exchanger is successively connected to a third water pump and an inlet of a second heat taking coil unit at an inner top of the heating water storage tank through a twelfth connecting pipeline. An outlet of the second heat taking coil unit is connected to a tube side inlet of the first refrigeration unit heat exchanger.

Connection between the ground source heat pump cooling/heating unit and the multi-level management unit for heat sources is described as follows: an outlet of a lower heat collection coil unit communicates with heat pump heat exchange circulation pipelines between the eighth valve and a second tube side inlet of the heat pump heat exchanger through a nineteenth connecting pipeline installed with a sixth valve. An inlet of the lower heat collection coil unit communicates with heat pump heat exchange circulation pipelines between the seventh valve and the sixth water pump through a twentieth connecting pipeline installed with the fifth valve.

An operation method for a multi-energy coupled cooling/heating system for buildings in a long-term cooling region in the present disclosure includes a cooling mode and a heating mode. The cooling mode includes a ground source heat pump cooling mode, a combined cooling mode of a ground source heat pump and a lithium bromide absorptive refrigeration unit, and a combined cooling mode of the ground source heat pump and the lithium bromide absorptive refrigeration unit with gas heat complementing.

A specific control process of the ground source heat pump cooling mode is described as follows:

Controlling valves and water pumps to: disconnect between the ground source heat pump cooling/heating unit, the multi-level management unit for heat sources, the lithium bromide absorptive refrigeration unit, and the gas heat complementing unit; disconnect between the multi-level management unit for heat sources, the lithium bromide absorptive refrigeration unit, and the gas heat complementing unit; and connect the ground source heat pump cooling/heating unit and the indirect evaporative cooling waste heat recovery unit, to form refrigeration cycle and a waste heat recovery cycle of the ground source heat pump unit, and chilled water circulation and domestic hot water supply for users. A control process of the valves and water pumps is described as follows:

Closing the third valve, the fourth valve, the fifth valve, the sixth valve, the ninth valve, the eleventh valve, the twelfth valve, the thirteenth valve, and the fifteenth valve; opening a first valve, the second valve, the seventh valve, the eighth valve, the tenth valve, the fourteenth valve, the sixteenth valve, the seventeenth valve, the eighteenth valve, and the nineteenth valve; and starting a first water pump, the second water pump, the fifth water pump, the sixth water pump, and the eighth water pump; operating an annular ground source heat pump unit.

A control process of a combined cooling mode of the ground source heat pump and the lithium bromide absorptive refrigeration unit is described as follows:

Controlling valves and water pumps to: disconnect between the gas heat complementing unit and the ground source heat pump cooling/heating unit, and the multi-level management unit for heat sources; connect the ground source heat pump cooling/heating unit and the lithium bromide absorptive refrigeration unit; and connect the multi-level management unit for heat sources, the ground source heat pump cooling/heating unit, and the lithium bromide absorptive refrigeration unit, to form refrigeration cycle of the ground source heat pump unit, refrigeration cycle of the lithium bromide absorptive refrigeration unit, waste heat recovery cycle, and chilled water circulation and high-temperature hot water supply on the user side. Control of the valves and water pumps is described as follows:

Closing the seventh valve, the eighth valve, the tenth valve, the eleventh valve, the twelfth valve, the thirteenth valve, and the fifteenth valve; opening the first valve, the second valve, the third valve, the fourth valve, the fifth valve, the sixth valve, the ninth valve, the fourteenth valve, the sixteenth valve, the seventeenth valve, the eighteenth valve, and the nineteenth valve; starting the first water pump, the second water pump, the third water pump, the fourth water pump, the fifth water pump, the sixth water pump, and the eighth water pump; and operating the annular ground source heat pump unit and the annular lithium bromide absorptive refrigeration unit.

A combined cooling mode of the ground source heat pump and the lithium bromide absorptive refrigeration unit with gas heat complementing is described as follows:

Controlling water pumps and valves to: disconnect between the gas heat complementing unit and the ground source heat pump cooling/heating unit; connect the multi-level management unit for heat sources, the ground source heat pump cooling/heating unit, the lithium bromide absorptive refrigeration unit, and the gas heat complementing unit; and connect the ground source heat pump cooling/heating unit and the lithium bromide absorptive refrigeration unit, to form refrigeration cycle of the ground source heat pump unit, refrigeration cycle of the lithium bromide absorptive refrigeration unit, waste heat recovery cycle, and chilled water circulation and high-temperature hot water supply on the user side. Control of the water pumps and valves is described as follows:

Closing the seventh valve, the eighth valve, the tenth valve, the thirteenth valve, and the fifteenth valve, opening the first valve, the second valve, the third valve, the fourth valve, the fifth valve, the sixth valve, the ninth valve, the eleventh valve, the twelfth valve, the fourteenth valve, the sixteenth valve, the seventeenth valve, the eighteenth valve, and the nineteenth valve; starting the first water pump, the second water pump, the third water pump, the fourth water pump, the fifth water pump, the sixth water pump, the seventh water pump, and the eighth water pump; and starting the gas-fired heating and hot water combi-boiler; operating the annular ground source heat pump unit and the annular lithium bromide absorptive refrigeration unit.

The heating mode includes a ground source heat pump heating mode and a gas heat complementing-ground source heat pump heating mode, and the ground source heat pump heating mode is described as follows:

The ground source heat pump heating mode includes the following steps:

Controlling valves and water pumps to: disconnect between the ground source heat pump cooling/heating unit, the multi-level management unit for heat sources, the lithium bromide absorptive refrigeration unit, the gas heat complementing unit, and the indirect evaporative cooling waste heat recovery unit; disconnect between the multi-level management unit for heat sources and the lithium bromide absorptive refrigeration unit; connect the multi-level management unit for heat sources and the gas heat complementing unit, to form heating cycle of the ground source heat pump unit, heating cycle on the user side, and domestic hot water supply. Steps for controlling the valves and pumps are as follows:

Closing the third valve, the fourth valve, the fifth valve, the sixth valve, the ninth valve, the thirteenth valve, the fifteenth valve, the eighteenth valve, and the nineteenth valve; opening the first valve, the second valve, the seventh valve, the eighth valve, the tenth valve, the eleventh valve, the twelfth valve, the fourteenth valve, the sixteenth valve, and the seventeenth valve; starting the first water pump, the second water pump, the fifth water pump, the sixth water pump, and the seventh water pump; and operating the annular ground source heat pump unit and the gas-fired heating and hot water combi-boiler.

The ground source heat pump heating mode with gas heat complementing includes the following steps:

Controlling the water pumps and valves to disconnect between the ground source heat pump cooling/heating unit, the lithium bromide absorptive refrigeration unit, and the indirect evaporative cooling waste heat recovery unit, disconnect between the multi-level management unit for heat sources, the lithium bromide absorptive refrigeration unit, and the gas heat complementing unit; connect the ground source heat pump cooling/heating unit, the multi-level management unit for heat sources, and the gas heat complementing unit, to form heating cycle of the ground source heat pump unit, heating cycle on the user side, and domestic hot water supply. Steps for controlling the valves and pumps are as follows:

Closing the third valve, the fourth valve, the seventh valve, the eighth valve, the ninth valve, the eleventh valve, the twelfth valve, the fourteenth valve, the eighteenth valve, and the nineteenth valve; opening the first valve, the second valve, the fifth valve, the sixth valve, the tenth valve, the thirteenth valve, the fifteenth valve, the sixteenth valve, and the seventeenth valve; starting the first water pump, the second water pump, the fifth water pump, and the sixth water pump; operating the annular ground source heat pump unit and the gas-fired heating and hot water combi-boiler; performing combined heating by the gas-fired heating and hot water combi-boiler and the ground source heat pump unit.

The beneficial effect of the present disclosure is high-quality cooling and heating can be provided for public buildings in hot and humid summer that needs long-term cooling. The present disclosure has a double-water tank structure, in which a hot water storage tank is used as an energy storage device, and a heat storage medium produces natural convection when storing heat energy, and due to a density difference, high-temperature heat energy rises, and low-temperature heat energy sinks, forming a stratification phenomenon. Based on the above principle of thermal stratification, a heat source classification management technology is used for the hot water storage tank, and cascade utilization is performed according to the grade of the heat source, to reduce energy loss and implement the integrated application of a variety of energy. In the cooling season, the ground source heat pump is used to provide cooling for users. When the cooling of the ground source heat pump is unstable or in extreme climates, the solar energy-driven lithium bromide absorptive refrigeration unit is combined with the ground source heat pump for cooling, and the lithium bromide absorptive refrigeration unit and a heat release end of the ground source heat pump complement heat for the hot water storage tank where the solar energy heat collector is placed, implementing multi-energy coupling of the system and improving the energy utilization efficiency. When a temperature of the hot water storage tank does not meet a starting condition for the lithium bromide absorptive refrigeration unit, an auxiliary heat source, the gas-fired heating and hot water combi-boiler is started to supply heat to the water tank, to maintain the stability of the cooling capacity of the system and ensure the comfort of the users. The indirect evaporative cooling waste heat recovery device provided by the present disclosure recovers cooling capacity in indoor exhaust air of a building, and implements pre-cooling and dehumidification treatment of outdoor fresh air of a high temperature and high humidity by utilizing an evaporative cooling principle of water, which is energy-saving, environmentally friendly, and efficient, and effectively alleviates the pressure of an excessive cooling load of the system in summer. In the heating season, the ground source heat pump is started for heating, and solar energy auxiliary heating is provided to ensure the stability of the system. In extreme climates, when the combined heating of solar energy and the ground source heat pump cannot meet the heating demand of users, the gas-fired heating and hot water combi-boiler is started to complement heat, maintaining the stability of heating. In addition, based on heat complementing by the solar energy heat collector and the gas-fired heating and hot water combi-boiler, all-weather domestic hot water can be provided for buildings all year round.

BRIEF DESCRIPTION OF THE DRAWINGS

The accompanying drawings constituting a part of the present disclosure are used to provide further understanding of the present disclosure. The exemplary embodiments of the present disclosure and descriptions thereof are used to explain the present disclosure, and do not constitute an undue limitation on the present disclosure.

DESCRIPTION OF THE EMBODIMENTS

The following further describes in detail embodiments of the present disclosure with reference to the accompanying drawings.

Figure 1:
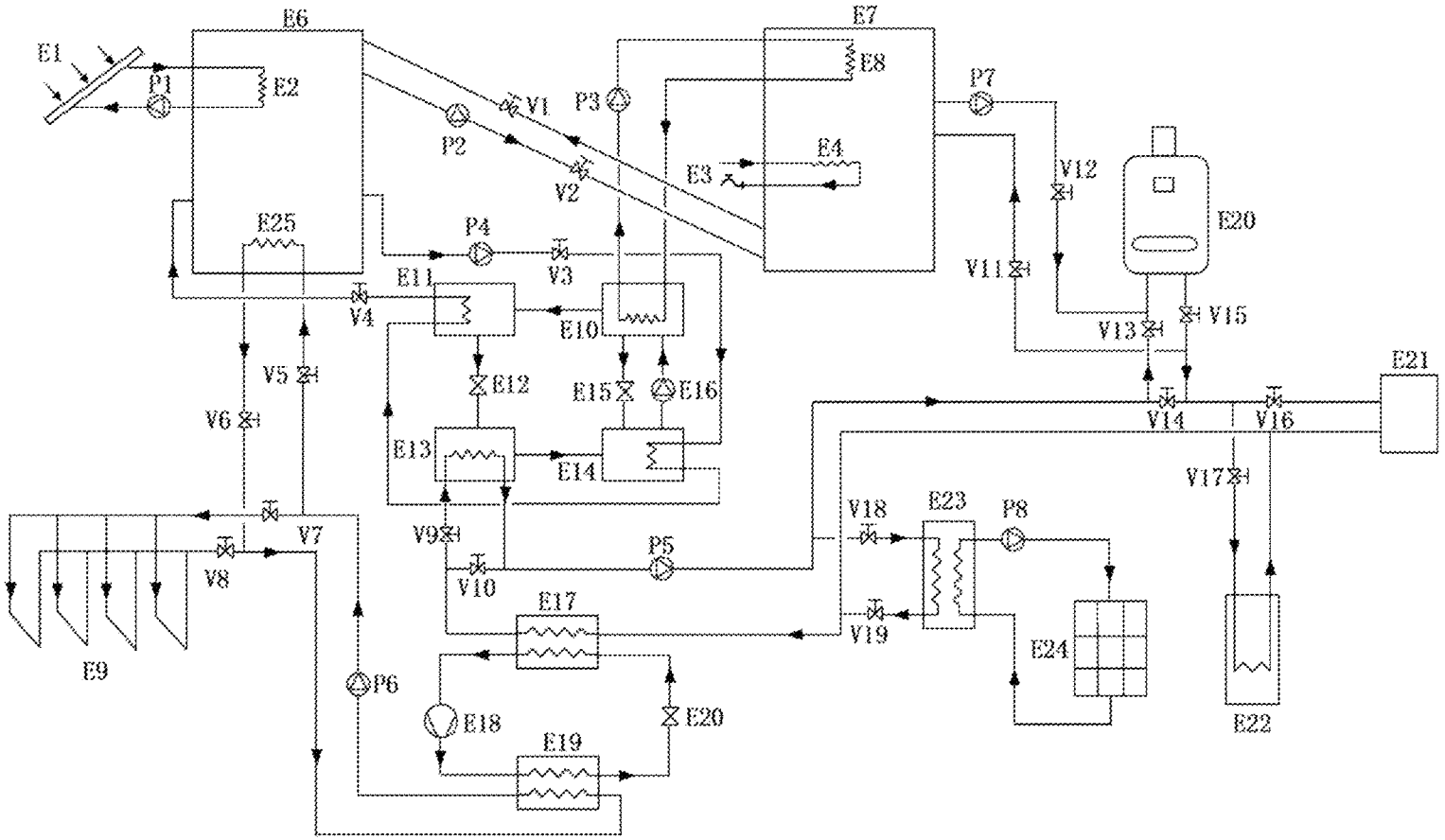
FIG. 1 is a schematic structural diagram of a cooling mode of a multi-energy coupled cooling/heating system for buildings in a long-term cooling region according to the present disclosure.

A multi-energy coupled cooling/heating system for buildings in a long-term cooling region shown in FIG. 1 includes a multi-level management unit for heat sources, a solar energy heat collection unit, a lithium bromide absorptive refrigeration unit, a gas heat complementing unit, a ground source heat pump cooling/heating unit, and an indirect evaporative cooling waste heat recovery unit. The multi-level management unit for heat sources is connected to the solar energy heat collection unit, the lithium bromide absorptive refrigeration unit, the gas heat complementing unit, and the ground source heat pump cooling/heating unit. The ground source heat pump cooling/heating unit is connected to the lithium bromide absorptive refrigeration unit, the gas heat complementing unit, and the indirect evaporative cooling waste heat recovery unit.

The lithium bromide absorptive refrigeration unit includes a first refrigeration unit heat exchanger E10. A first shell side outlet of the first refrigeration unit heat exchanger E10 is successively connected to a shell side inlet of a second refrigeration unit heat exchanger E11, a shell side outlet of the second refrigeration unit heat exchanger E11, a first throttle valve E12, a shell side inlet of a third refrigeration unit heat exchanger E13, a shell side outlet of the third refrigeration unit heat exchanger E13, a shell side inlet of a fourth refrigeration unit heat exchanger E14, a shell side outlet of the fourth refrigeration unit heat exchanger E14, a first solution pump E16, and a shell side inlet of the first refrigeration unit heat exchanger through refrigeration circulation pipelines. A second outlet of the first refrigeration unit heat exchanger E10 is connected to a second shell side inlet of the fourth refrigeration unit heat exchanger E14 through a backflow pipeline provided with a throttle valve E15. The first refrigeration unit heat exchanger E10, the second refrigeration unit heat exchanger E11, the third refrigeration unit heat exchanger E13, and the fourth refrigeration unit heat exchanger E14 are connected in series to form an annular lithium bromide absorptive refrigeration unit. An outlet of a fan coil unit E21 is successively connected to a first tube side inlet of a first ground source heat pump heat exchanger E17, a first tube side outlet of the first ground source heat pump heat exchanger E17, a tenth valve V10, a fifth water pump P5, a fourteenth valve V14, a sixteenth valve V16, and an inlet of the fan coil unit E21 through fan coil unit heat exchange circulation pipelines. An inlet of a first connecting pipeline installed with a ninth valve V9 communicates with fan coil unit heat exchange circulation pipelines between a first tube side outlet of the first ground source heat pump heat exchanger E17 and the tenth valve V10, and an outlet of the first connecting pipeline is connected to a tube side inlet of the third refrigeration unit heat exchanger E13. An inlet of a second connecting pipeline is connected to a tube side outlet of the third refrigeration unit heat exchanger E13, and an outlet of the second connecting pipeline communicates with fan coil unit heat exchange circulation pipelines between the tenth valve V10 and the fifth water pump P5.

The first tube side outlet of the first ground source heat pump heat exchanger E17 is a cooling discharge outlet of the ground source heat pump cooling/heating unit. In summer, a lithium bromide refrigeration unit and a ground source heat pump operate in series to share a cooling load of a building, ensuring cooling demands of users in extreme climates, resolving a problem of unstable cooling of the ground source heat pump, and greatly ensuring the comfort of users.

The ground source heat pump cooling/heating unit includes a second tube side outlet of the first ground source heat pump heat exchanger E17, a compressor E18, a first tube side inlet of the second ground source heat pump heat exchanger E19, a first tube side outlet of the second ground source heat pump heat exchanger E19, a second throttle valve E20, and a second tube side inlet of the first ground source heat pump heat exchanger E17 that are sequentially connected through soil source circulation pipelines. The first ground source heat pump heat exchanger E17, the heat pump unit compressor E18, the second ground source heat pump exchanger E19, and the second throttle valve E20 are connected in series to form an annular ground source heat pump unit. A second shell side outlet of the heat pump heat exchanger E19 is successively connected to a sixth water pump P6, a seventh valve V7, an inlet of a buried pipe heat exchanger E9, an outlet of the buried pipe heat exchanger E9, an eighth valve V8, and a second shell side inlet of the second ground source heat pump heat exchanger E19 through heat pump heat exchange circulation pipelines.

One end of a third connecting pipeline is connected to an inlet of a fresh air heat exchanger E22, and the other end communicates with fan coil unit heat exchange circulation pipelines between a fourteenth valve V14 and a sixteenth valve V16. One end of a fourth connecting pipeline is connected to an outlet of the fresh air heat exchanger E22, and the other end communicates with fan coil unit heat exchange circulation pipelines between a first tube side inlet of the first ground source heat pump heat exchanger E17 and an outlet of a fan coil unit E21.

The gas heat complementing unit includes a gas-fired heating and hot water combi-boiler E20, and the multi-level management unit for heat sources includes a heating water storage tank E7. A heat complementing hot water outlet of the heating water storage tank E7 is successively connected to a seventh water pump P7, a twelfth valve V12, a heating inlet of the gas-fired heating and hot water combi-boiler E20, a heating outlet of the gas-fired heating and hot water combi-boiler E20, a fifteenth valve V15, an eleventh valve V11, and a heat complementing hot water inlet of the heating water storage tank E7 through heat complementing circulation pipelines. One end of a fifth connecting pipeline communicates with heat complementing circulation pipelines between a fourteenth valve V14 and the eleventh valve V11, and the other end communicates with fan coil unit heat exchange circulation pipelines between a fifteenth valve V15 and a sixteenth valve V16. One end of a sixth connecting pipeline installed with a thirteenth valve V13 communicates with fan coil unit heat exchange circulation pipelines between the fourteenth valve V14 and a fifth water pump, and the other end communicates with heat complementing circulation pipelines between a twelfth valve V12 and a heating inlet of the gas-fired heating and hot water combi-boiler E20.

The indirect evaporative cooling waste heat recovery unit includes an indirect evaporative cooler E24 and a cooling complementing heat exchanger E23. A wet channel outlet of the indirect evaporative cooler E24 is successively connected to an inlet of a refrigeration side pipeline of the cooling complementing heat exchanger, an outlet of the refrigeration side pipeline, an eighth water pump P8, and a wet channel inlet of the indirect evaporative cooler through a cooling circulation pipeline. An inlet of a cooling taking side pipeline of the cooling complementing heat exchanger communicates with fan coil unit heat exchange circulation pipelines between the fifth water pump P5 and the fourteenth valve V14 through a seventh connecting pipeline installed with an eighteenth valve V18, and an outlet of the cooling taking side pipeline of the cooling complementing heat exchanger communicates with the fan coil unit heat exchange circulation pipelines between a first tube side inlet of the first ground source heat pump heat exchanger E17 and an outlet of a fan coil unit E21 through an eighth connecting pipeline installed with a nineteenth valve V19. A dry channel inlet of the indirect evaporative cooler E24 communicates with outdoor fresh air, and a dry channel outlet is connected to an air inlet of the fresh air heat exchanger E22.

Figure 2:
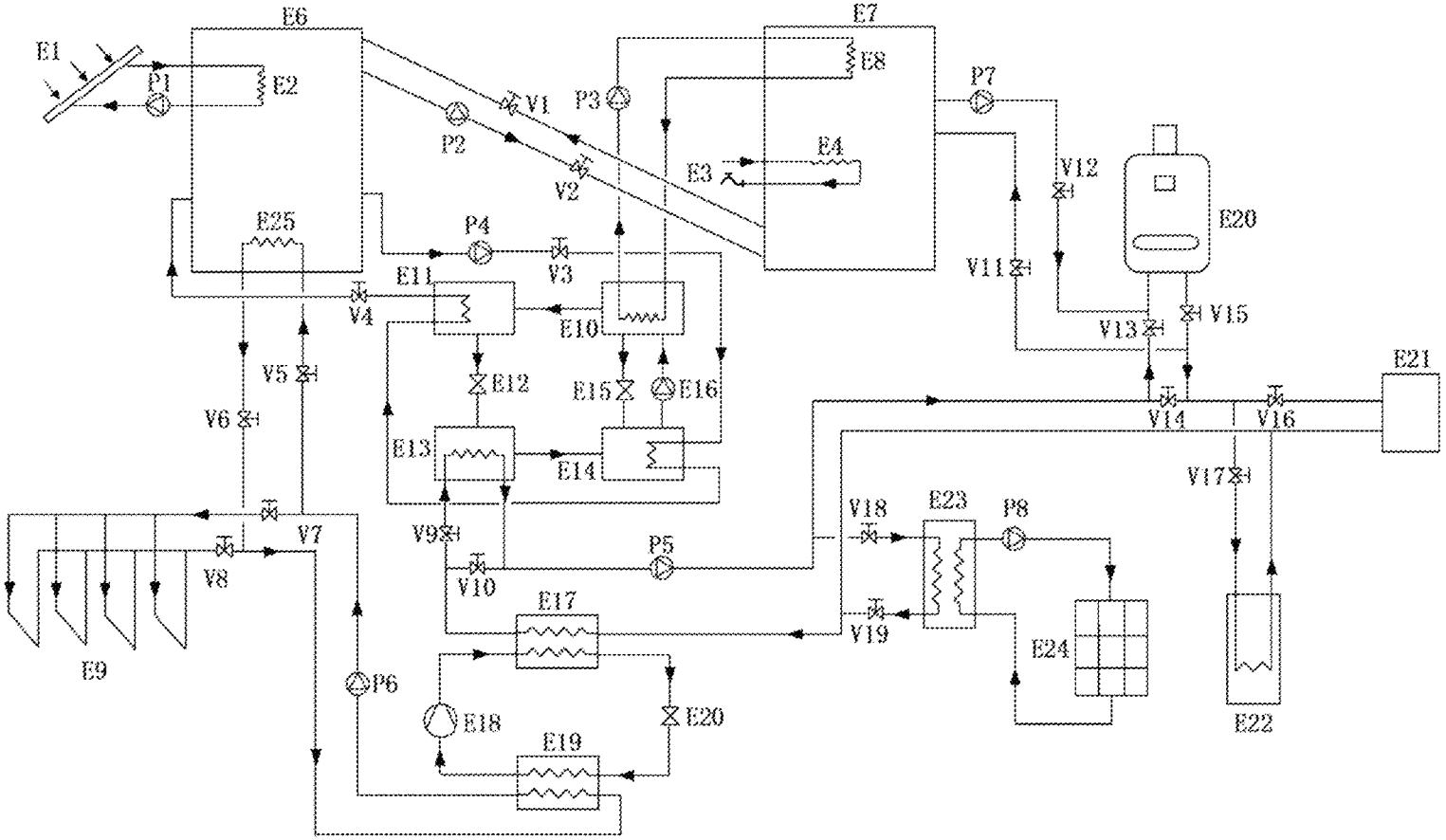
FIG. 2 is a schematic structural diagram of a heating mode of the multi-energy coupled cooling/heating system for buildings in a long-term cooling region according to the present disclosure.
Figure 3:
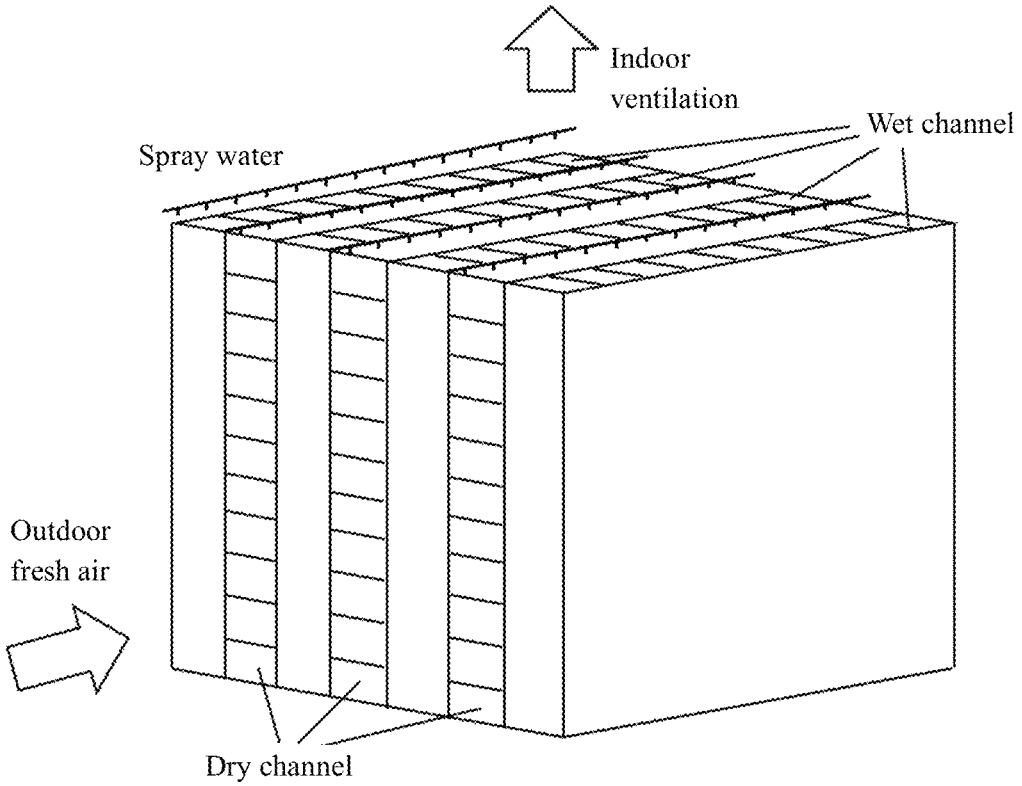
FIG. 3 is a schematic structural diagram of an indirect evaporative cooler according to the present disclosure.

The structure of the indirect evaporative cooler E24 is shown in FIG. 2. Indoor exhausted air enters a wet channel of the indirect evaporative cooler E24 and directly contacts sprayed water, with a state change process shown in FIG. 3, is cooled and humidified from an initial state point $K_0$ to $K_1$, and is then discharged outdoors. Outdoor fresh air with a high temperature and high humidity enters a dry channel of the indirect evaporative cooler E24, is cooled by low-temperature air in the wet channel, and is cooled and dehumidified from an initial state point $T_0$ to $T_1$. Pre-cooling and dehumidification of the outdoor fresh air are implemented through a principle of water evaporative cooling, to relieve the cooling pressure of the system in summer.

The multi-level management unit for heat sources includes a heat collection tank E6 and the heating water storage tank E7. An upper circulating water outlet at the top of the heat collection tank E6 is successively connected to a second water pump P2, a second electromagnetic valve V2, and a lower circulating water inlet at the bottom of the heating water storage tank E7 through a ninth connecting pipeline. A lower circulating water outlet at the bottom of the heating water storage tank E7 is connected to a first electromagnetic valve V1 and an upper circulating water inlet at the top of the heat collection tank E6 through a tenth connecting pipeline. An outlet of a second heat taking coil unit E4 installed in the middle of the heating water storage tank E7 is connected to a domestic water end E3 to satisfy the users' demand for domestic hot water throughout the year.

The solar energy heat collection unit includes a solar energy heat collector E1 and an upper heat collection coil unit E2 at an inner top of the heat collection tank E6, and an outlet of the solar energy heat collector E1 is connected to an inlet of the upper heat collection coil unit E2. After heat exchange with hot water stored in the heat collection tank E6, an outlet of the heat collection coil unit E2 is connected to an inlet of the solar energy heat collector E1 through a first water pump P1, and a lower heat collection coil unit E25 is disposed below the inside of the heat collection tank E6.

A connection structure of the lithium bromide absorptive refrigeration unit and the multi-level management unit for heat sources is described as follows: a heat collection hot water outlet at a lower part of the heat collection tank E6 is successively connected to a fourth water pump P4, a third valve V3, and a tube side inlet of a fourth refrigeration unit heat exchanger E14 through an eleventh connecting pipeline. A tube side outlet of the fourth refrigeration unit heat exchanger E14 is connected to a tube side inlet of a second refrigeration unit heat exchanger E11, a tube side outlet of the second refrigeration unit heat exchanger E11, the fourth valve V4, and a heat collection hot water inlet at a lower part of the heat collection tank E6. A tube side outlet of the first refrigeration unit heat exchanger E10 is successively connected to a third water pump P3 and an inlet of a second heat taking coil unit E8 at an inner top of the heating water storage tank E7 through a twelfth connecting pipeline. An outlet of the second heat taking coil unit E8 is connected to a tube side inlet of the first refrigeration unit heat exchanger E10.

Connection between the ground source heat pump cooling/heating unit and the multi-level management unit for heat sources is described as follows: an outlet of a lower heat collection coil unit E25 communicates with heat pump heat exchange circulation pipelines between the eighth valve and a second tube side inlet of the second heat pump heat exchanger E19 through a nineteenth connecting pipeline installed with a sixth valve V6. An inlet of the lower heat collection coil unit E25 communicates with heat pump heat exchange circulation pipelines between the seventh valve V7 and the sixth water pump P6 through a twentieth connecting pipeline installed with the fifth valve V5.

The multi-level management unit for heat sources is based on a principle of temperature stratification of a hot water storage tank, and water level nodes of the heat collection tank E6 and the heating water storage tank E7 are designed based on stratifications of different heat sources. Node positions designed for the heat collection tank E6 are respectively from top to bottom: a circulating water inlet and outlet at the top, an upper heat collection coil unit E2 of the solar energy heat collection unit at the top, a heat collection hot water inlet and outlet at the bottom that are connected to the lithium bromide absorptive refrigeration unit, and a lower heat collection coil unit E25 at the bottom connected to the ground source heat pump cooling/heating unit. Node positions designed for the heating water storage tank E7 are respectively from top to bottom: a first heat taking coil unit E8 at the top, a heat complementing hot water outlet and inlet at the top connected to the gas heat complementing unit, a second heat taking coil unit E4 in the middle, and a circulating water outlet and inlet at the bottom connected to the heat collection tank E6. In the cooling season, heat energy transfer is implemented between the heat collection tank E6 and the heating water storage tank E7 driven by the second water pump P2, and high-grade heat energy in the heat collection tank E6 is concentrated in the heating water storage tank E7, to provide high-temperature heat energy for the lithium bromide absorptive refrigeration unit.

As shown in the drawings, an operation method for the multi-energy coupled cooling/heating system for buildings in a long-term cooling region includes a cooling mode and a heating mode. The cooling mode includes a ground source heat pump cooling mode, a combined cooling mode of a ground source heat pump and a lithium bromide absorptive refrigeration unit, and a combined cooling mode of the ground source heat pump and the lithium bromide absorptive refrigeration unit with gas heat complementing.

A specific control process of the ground source heat pump cooling mode is described as follows:

Controlling valves and water pumps to: disconnect between the ground source heat pump cooling/heating unit, the multi-level management unit for heat sources, the lithium bromide absorptive refrigeration unit, and the gas heat complementing unit; disconnect between the multi-level management unit for heat sources, the lithium bromide absorptive refrigeration unit, and the gas heat complementing unit; and connect the ground source heat pump cooling/heating unit and the indirect evaporative cooling waste heat recovery unit, to form refrigeration cycle and waste heat recovery cycle of the ground source heat pump unit, and chilled water circulation and domestic hot water supply for users. A control process of the valves and water pumps is described as follows:

Closing a third valve V3, a fourth valve V4, a fifth valve V5, a sixth valve V6, a ninth valve V9, an eleventh valve V11, a twelfth valve V12, a thirteenth valve V13, and a fifteenth valve V15; opening a first valve V1, a second valve V2, a seventh valve V7, an eighth valve V8, a tenth valve V10, a fourteenth valve V14, a sixteenth valve V16, a seventeenth valve V17, an eighteenth valve V18, and a nineteenth valve V19; starting a first water pump P1, a second water pump P2, a fifth water pump P5, a sixth water pump P6, and an eighth water pump P8; operating an annular ground source heat pump unit; and using only cooling capacity stored in the soil and natural cooling capacity evaporated by the water phase change to meet cooling load demand of a building.

The refrigeration cycle of the ground source heat pump unit includes the following steps:

The ground source heat pump unit compressor E18 compresses a low-temperature gaseous refrigerant into a high-temperature gaseous refrigerant, and the compressed refrigerant flows into the second ground source heat pump heat exchanger E19 to heat exchange with return water of circulating water from the soil source heat exchanger E9, and then is cooled down to liquefy it into a liquid refrigerant, and then the liquid refrigerant flows into a throttle valve E20, the liquid refrigerant expands into a gas-liquid two-phase mixed refrigerant after throttling by the throttle valve E20, and the gas-liquid two-phase mixed refrigerant enters the first ground source heat pump heat exchanger E17, and is heated after absorbing heat of cooling circulation return water on the user in the first ground source heat pump heat exchanger E17, and the gas-liquid two-phase mixed refrigerant becomes superheated refrigerant vapor, and the superheated vapor finally returns to the ground source heat pump unit compressor E18, so that heating cycle of the ground source heat pump unit is completed.

Figure 4:
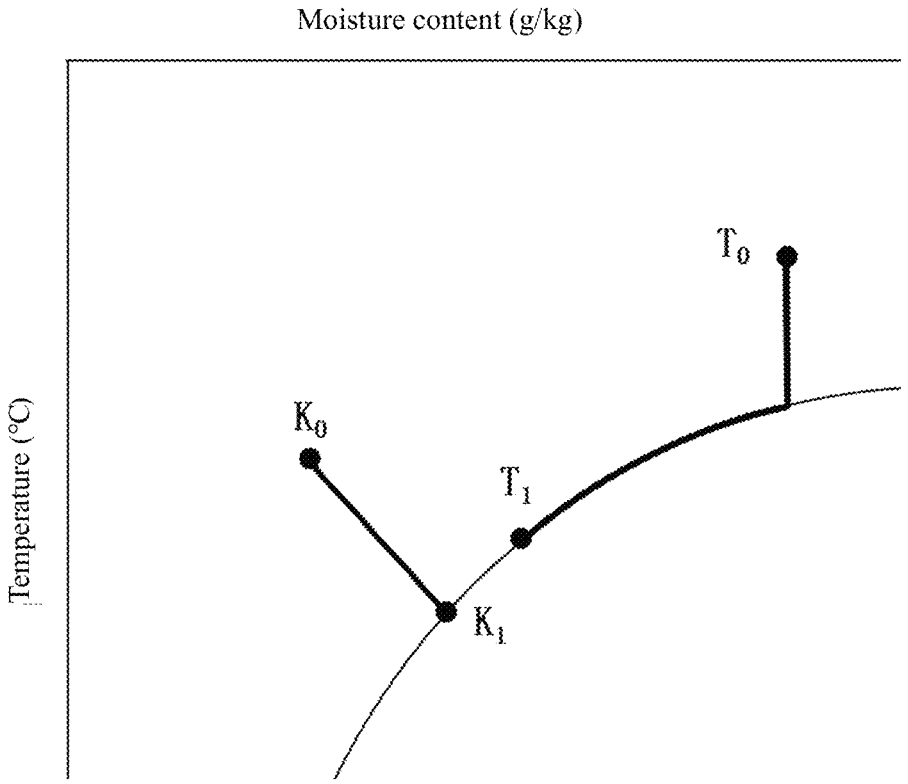
FIG. 4 is an enthalpy and humidity diagram of a change in the state of air in an indirect evaporative cooler.

The waste heat recovery cycle includes the following steps (an internal structure of the indirect evaporative cooler is shown in FIG. 3):

Cooling water flows out from a wet channel outlet of the indirect evaporative cooler E24, enters the cooling complementing heat exchanger E23 to heat exchange with chilled water in a cooling taking side pipeline in the cooling complementing heat exchanger E23, and then is cooled down to form chilled cooling water, chilled cooling water enters a wet channel of the indirect evaporative cooler E24 under the pressurization of the eighth water pump P8, performs direct heat-wet exchange with a building's indoor exhaust air in the wet channel, and performs indirect heat-exchange with outside fresh air in a dry channel on the other side (the change of air state is shown in an enthalpy and wetness diagram of FIG. 4); then cooling water through the indirect heat exchange flows out from the wet channel outlet of the indirect evaporative cooler and returns to the cooling complementing heat exchanger E23, so that the waste heat recovery cycle is completed.

The user-side chilled water cycle includes the following steps:

Return water of chilled water flowing out from the cooling complementing heat exchanger E23, the fan coil unit E21, and the fresh air heat exchanger E22 enters a first pipe of the first ground source heat pump heat exchanger E17 to heat exchange with a gas-liquid two-phase mixed refrigerant in a second pipe of the heat pump heat exchanger, and then is cooled down to form chilled water, the chilled water flowing out from a first tube side outlet of the first ground source heat pump heat exchanger E17 returns to the fan coil unit E21, the fresh air heat exchanger E22, and the cooling complementing heat exchanger E23 again on the user side again under the pressurization of the fifth water pump P5, so that the user-side chilled water circulation is completed.

The domestic hot water supply includes the following steps:

A high-temperature refrigerant in a solar energy heat collector E1 enters an upper heat collection coil unit E2 to heat exchange with stored hot water at an upper part of the heat collection tank E6, and then is cooled down, the cooled refrigerant returns to the solar energy heat collector E1 under the pressurization of the water pump P1. The stored hot water in the heat collection tank is heated by a heat collection coil unit; when driven by the second water pump P2, high-temperature stored hot water at the top of the heat collection tank E6 enters the bottom of the heating water storage tank E7 through a lower circulating water inlet of the heating water storage tank E7, and low-temperature stored hot water at the bottom of the heating water storage tank E6 enters the top of the heat collection tank E6 through a lower circulating water outlet, so that high-grade heat energy of the heat collection tank E6 is transferred to the heating water storage tank E7; and domestic tap water enters a second heat taking coil unit E4 and is heated after heat exchange with stored hot water in the middle of the heating water storage tank E7, and heated tap water is transferred to the user to meet the domestic hot water demand of users.

A control process of a combined cooling mode of the ground source heat pump and the lithium bromide absorptive refrigeration unit is described as follows:

Controlling valves and water pumps to: disconnect between the gas heat complementing unit and the ground source heat pump cooling/heating unit, and the multi-level management unit for heat sources; connect the ground source heat pump cooling/heating unit and the lithium bromide absorptive refrigeration unit; and connect the multi-level management unit for heat sources, the ground source heat pump cooling/heating unit, and the lithium bromide absorptive refrigeration unit, to form refrigeration cycle of the ground source heat pump unit, refrigeration cycle of the lithium bromide absorptive refrigeration unit, waste heat recovery cycle, and chilled water circulation and high-temperature hot water supply on the user side. Control of the valves and water pumps is described as follows:

Closing the seventh valve V7, the eighth valve V8, the tenth valve V10, the eleventh valve V11, the twelfth valve V12, the thirteenth valve V13, and the fifteenth valve V15; opening the first valve V1, the second valve V2, the third valve V3, the fourth valve V4, the fifth valve V5, the sixth valve V6, the ninth valve V9, the fourteenth valve V14, the sixteenth valve V16, the seventeenth valve V17, the eighteenth valve V18, and the nineteenth valve V19; starting the first water pump P1, the second water pump P2, the third water pump P3, the fourth water pump P4, the fifth water pump P5, the sixth water pump P6, and the eighth water pump P8; and operating the annular ground source heat pump unit and the annular lithium bromide absorptive refrigeration unit. The annular lithium bromide absorptive refrigeration unit is jointly driven by solar energy coupling, ground source heat pump, and self-heat release.

The refrigeration cycle of the ground source heat pump unit includes the following steps:

The ground source heat pump unit compressor E18 compresses low-temperature refrigerant vapor into high-temperature refrigerant vapor, and the compressed refrigerant flows into the second ground source heat pump heat exchanger E19 to heat exchange with return water of circulating water from the lower heat collection coil unit E25, and is cooled down to liquefy it into a liquid refrigerant, and then the liquid refrigerant flows into a throttle valve E20, the liquid refrigerant expands into a gas-liquid two-phase mixed refrigerant after throttling by the throttle valve E20, and the gas-liquid two-phase mixed refrigerant enters a second pipe of the first ground source heat pump heat exchanger E17, and a temperature of the gas-liquid two-phase mixed refrigerant rises after heat exchange with cooling circulation return water on the user side in the first pipe in the first ground source heat pump heat exchanger E17, and the gas-liquid two-phase mixed refrigerant becomes superheated refrigerant vapor, and the superheated vapor finally returns to the ground source heat pump unit compressor E18, so that heating cycle of the ground source heat pump unit is completed.

The refrigeration cycle of the lithium bromide absorptive refrigeration unit includes the following steps:

Refrigerant vapor flowing out from a third refrigeration unit heat exchanger E13 enters a fourth refrigeration unit heat exchanger E14, concentrated lithium bromide solution in the fourth refrigeration unit heat exchanger E14 absorbs the refrigerant vapor from the third refrigeration unit heat exchanger E13, the concentrated lithium bromide solution is diluted into dilute lithium bromide solution, and heat released during absorption is taken away by the low-temperature circulating water from the heat collection tank E6 in the pipelines; the dilute lithium bromide solution enters the first refrigeration unit heat exchanger E10 under the boost of a first solution pump E16, and the dilute lithium bromide solution is heated by circulating hot water from the first heat taking coil unit E8 in a heat exchanger pipe in a shell of the first refrigeration unit heat exchanger E10, in this process, a refrigerant in the dilute lithium bromide solution evaporates into refrigerant vapor, the refrigerant vapor enters a second refrigeration unit heat exchanger E11, and the dilute lithium bromide solution in the first refrigeration unit heat exchanger E10 is heated and concentrated into concentrated lithium bromide solution, goes through pressure reduction and throttling by a throttle valve E15, and returns to the fourth refrigeration unit heat exchanger E14; the refrigerant vapor from the first refrigeration unit heat exchanger E10 is cooled and liquefied into a liquid refrigerant by low-temperature circulating water from a tube side outlet of the fourth refrigeration unit heat exchanger E14 in the heat exchanger pipe in the shell of the second refrigeration unit heat exchanger E11, then the liquid refrigerant flows out from the second refrigeration unit heat exchanger E11 and goes through pressure reduction and throttling by the first throttle valve E12 to become a liquid refrigerant to enter the third refrigeration unit heat exchanger E13, the liquid refrigerant in the third refrigeration unit heat exchanger E13 absorbs heat in circulating chilled water in the heat exchanger pipe in the shell of the third refrigeration unit heat exchanger E13, thereby being evaporated and vaporized into refrigerant vapor, and then the refrigerant vapor returns to the fourth refrigeration unit heat exchanger E14, so that refrigeration cycle of the lithium bromide refrigeration unit is completed.

Steps of the waste heat recovery cycle in the combined cooling mode of the ground source heat pump and the lithium bromide absorptive refrigeration unit are the same as steps of the waste heat recovery cycle in the ground source heat pump cooling mode.

The user-side chilled water cycle includes the following steps:

Return water of chilled water of more than 12° C. flowing out from the cooling complementing heat exchanger E23, the fan coil unit E21, and the fresh air heat exchanger E22 enters a first pipe in the first ground source heat pump heat exchanger E17 for heat exchange and cooling, and cooled chilled water flows from the first ground source heat pump heat exchanger E17 to the third refrigeration unit heat exchanger E13 through the second connecting pipeline, the chilled water in a pipe of the third refrigeration unit heat exchanger E13 is cooled to about 7° C. by the refrigerant in the shell of the heat exchanger, then cooled chilled water enters fan coil unit heat exchange circulation pipelines under the pressurization of the fifth water pump P5 and returns to the fan coil unit E21, the fresh air heat exchanger E22, and the cooling complementing heat exchanger E23 on the user side respectively, so that the user-side chilled water circulation is completed.

The high-temperature hot water supply includes the following steps:

The high-temperature refrigerant from the solar energy heat collector E1 enters the upper heat collection coil unit E2 to heat exchange with stored hot water at an upper part of the heat collection tank E6, and then is cooled down to form a cooled refrigerant, the cooled refrigerant returns to the solar energy heat collector E1 under the pressurization of the first water pump P1; the stored hot water at the upper part of the heat collection tank E6 is heated by the upper heat collection coil unit E2; stored hot water at a lower part of the heat collection tank E6 enters a pipe of the fourth refrigeration unit heat exchanger E14 when driven by the fourth water pump P4 and is heated after heat exchange with the lithium bromide solution in a shell of the fourth refrigeration unit heat exchanger, heated circulating water flows out from the fourth refrigeration unit heat exchanger E14 into a pipe of the second refrigeration unit heat exchanger E11, is heated to 50-70° C. by a refrigerant in a shell of the second refrigeration unit heat exchanger, and then water returns to the heat collection tank E6; low-temperature circulating water after heat exchange in the lower heat collection coil unit E25 at the bottom of the heat collection water tank E6 enters a second pipe of the second ground source heat pump heat exchanger E19, and is heated after heat exchange with a gaseous refrigerant in a first pipe of the second ground source heat pump heat exchanger E19, and heated low-temperature circulating water returns to the lower heat collection coil unit E25 under the pressurization of the sixth water pump P6; high-temperature stored hot water at the top of the heat collection tank E6 enters the heating water storage tank E7 through a lower circulating water inlet of the heating water storage tank E7 when driven by the second water pump P2, and low-temperature stored hot water at the bottom of the heating water storage tank E7 enters the top of the heat collection tank E6 through a lower circulating water outlet, so that high-grade heat energy of the heat collection tank E6 is transferred to the heating water storage tank E7; domestic tap water enters a second heat taking coil unit E4 and is heated after heat exchange with stored hot water in the middle of the heating water storage tank E7, and heated tap water is transferred to the user to meet the domestic hot water demand of users; high-temperature hot water in the first heat taking coil unit E8 at the top of the heating water storage tank E7 enters a pipe of the first refrigeration unit heat exchanger E10 to heat exchange with the lithium bromide solution in the shell and then is cooled down, to provide high-quality heat energy for the lithium bromide absorptive refrigeration unit; and circulating water with heat exchanged is driven by the third water pump P3 to return to the first heat taking coil unit E8, so that the supply of high-temperature hot water is completed.

A combined cooling mode of the ground source heat pump and the lithium bromide absorptive refrigeration unit with gas heat complementing is described as follows:

Controlling water pumps and valves to: disconnect between the gas heat complementing unit and the ground source heat pump cooling/heating unit; connect the multi-level management unit for heat sources, the ground source heat pump cooling/heating unit, and the lithium bromide absorptive refrigeration unit, the gas heat complementing unit; and connect the ground source heat pump cooling/heating unit and the lithium bromide absorptive refrigeration unit, to form refrigeration cycle of the ground source heat pump unit, refrigeration cycle of the lithium bromide absorptive refrigeration unit, waste heat recovery cycle, and chilled water circulation and high-temperature hot water supply on the user side. Control of the water pumps and valves is described as follows:

Closing the seventh valve V7, the eighth valve V8, the tenth valve V10, the thirteenth valve V13, and the fifteenth valve V15, opening the first valve V1, the second valve V2, the third valve V3, the fourth valve V4, the fifth valve V5, the sixth valve V6, the ninth valve V9, the eleventh valve V11, the twelfth valve V12, the fourteenth valve V14, the sixteenth valve V16, the seventeenth valve V17, the eighteenth valve V18, and the nineteenth valve V19; starting the first water pump P1, the second water pump P2, the third water pump P3, the fourth water pump P4, the fifth water pump P5, the sixth water pump P6, the seventh water pump P7, and the eighth water pump P8, and starting the gas-fired heating and hot water combi-boiler E20; and operating the annular ground source heat pump unit and the annular lithium bromide absorptive refrigeration unit. The lithium bromide absorptive refrigeration unit is jointly driven by solar energy coupled with gas, the ground source heat pump, and self-heat release.

Steps of refrigeration cycle of the ground source heat pump unit in the combined cooling mode for the ground source heat pump and the lithium bromide absorptive refrigeration unit with gas heat complementing are the same as the steps of the refrigeration cycle of the ground source heat pump unit in the combined cooling mode for the ground source heat pump and the lithium bromide absorptive refrigeration unit;

Steps of refrigeration cycle of the lithium bromide absorptive refrigeration unit in the combined cooling mode for the ground source heat pump and the lithium bromide absorptive refrigeration unit with gas heat complementing are the same as the steps of the refrigeration cycle of the lithium bromide absorptive refrigeration unit in the combined cooling mode for the ground source heat pump and the lithium bromide absorptive refrigeration unit.

Steps of the waste heat recovery cycle in the combined cooling mode of the ground source heat pump and the lithium bromide absorptive refrigeration unit with gas heat complementing are the same as steps of the waste heat recovery cycle in the ground source heat pump cooling mode.

Steps of user-side chilled water circulation in the combined cooling mode for the ground source heat pump and the lithium bromide absorptive refrigeration unit with gas heat complementing are the same as steps of user-side chilled water circulation in the ground source heat pump cooling mode.

The high-temperature hot water supply includes the following steps:

A high-temperature refrigerant in the solar energy heat collector E1 enters the upper heat collection coil unit E2 to heat exchange with stored hot water at an upper part of the heat collection tank E6, and then is cooled down, a cooled high-temperature refrigerant returns to the solar energy heat collector E1 under the pressurization of the water pump P1; the stored hot water in the heat collection tank E6 is heated by the upper heat collection coil unit E2; the stored hot water at the lower part of the heat collection tank E6 enters the pipe of the fourth refrigeration unit heat exchanger E14 when driven by the fourth water pump P4, and is heated after heat exchange with the lithium bromide solution in the shell of the fourth refrigeration unit heat exchanger, circulating water that enters the fourth refrigeration unit heat exchanger and is heated flows out from the fourth refrigeration unit heat exchanger E14 and enters the pipe of the second refrigeration unit heat exchanger E11, and is heated again by the gaseous refrigerant in the shell of the second refrigeration unit heat exchanger, and the circulating water that is heated again in the shell of the second refrigeration unit heat exchanger returns to the heat collection tank E6; low-temperature circulating water in the lower heat collection coil unit E25 at the bottom of the heat collection tank E6 enters a second pipe of the second ground source heat pump heat exchanger E19, is heated after heat exchange with a gaseous refrigerant in the first pipe of the second ground source heat pump heat exchanger, and heated low-temperature circulating water returns to the lower heat collection coil unit E25 under the pressurization of the sixth water pump P6; when driven by the second water pump P2, high-temperature stored hot water at the top of the heat collection tank E6 enters the bottom of the heating water storage tank E7, and low-temperature stored hot water at the bottom of the heating water storage tank E7 enters the top of the heat collection tank E6 through a lower circulating water outlet of the heating water storage tank E7, so that high-grade heat energy of the heat collection tank E6 is transferred to the heating water storage tank E7; and circulating water at an upper part of the heating water storage tank E7 enters the gas-fired heating and hot water combi-boiler E20 through the heat complementing circulation pipelines under the pressurization of the seventh water pump P7 and is heated after heat exchange with a high-temperature flue gas in the gas-fired heating and hot water combi-boiler E20, and heated circulating water returns to the heating water storage tank E7; domestic tap water enters a second heat taking coil unit E4 and is heated after heat exchange with stored hot water in the middle of the heating water storage tank E7, and heated water is transferred to the user, to meet the domestic hot water demand of users; high-temperature hot water in the first heat taking coil unit E8 at the top of the heating water storage tank E7 enters a pipe of the first refrigeration unit heat exchanger E10, to provide high-quality heat energy for the first refrigeration unit heat exchanger; circulating water after heat exchange is driven by the third water pump P3 to be back to the first heat collection coil unit E8, so that high-temperature hot water supply is completed.

The heating mode includes a ground source heat pump heating mode and a gas heat complementing-ground source heat pump heating mode, and the ground source heat pump heating mode is described as follows:

The ground source heat pump heating mode includes the following steps:

Controlling valves and water pumps to: disconnect between the ground source heat pump cooling/heating unit, the multi-level management unit for heat sources, the lithium bromide absorptive refrigeration unit, the gas heat complementing unit, and the indirect evaporative cooling waste heat recovery unit; disconnect between the multi-level management unit for heat sources and the lithium bromide absorptive refrigeration unit; and connect the multi-level management unit for heat sources and the gas heat complementing unit, to form heating cycle of the ground source heat pump unit, heating cycle on the user side, and domestic hot water supply. Steps for controlling the valves and pumps are as follows:

Closing the third valve V3, the fourth valve V4, the fifth valve V5, the sixth valve V6, the ninth valve V9, the thirteen valve V13, the fifteen valve V15, the eighteenth valve V18, and the ninth valve V19; opening the first valve V1, the second valve V2, the seventh valve V7, the eighth valve V8, the tenth valve V10, the eleventh valve V11, the twelfth valve V12, the fourteenth valve V14, the sixteenth valve V16, and the seventeenth valve V17; starting the first water pump P1, the second water pump P2, the fifth water pump P5, the sixth water pump P6, and the seventh water pump P7; operating the annular ground source heat pump unit and the gas-fired heating and hot water combi-boiler E20; and in winter, using heat stored in the soil to heat a building, and using the solar energy combined with gas to meet the domestic hot water demand of users.

The heating cycle of the ground source heat pump unit includes the following steps:

The ground source heat pump unit compressor E18 compresses and heats a low-temperature gaseous refrigerant, and the compressed refrigerant flows into a second pipe of the first ground source heat pump heat exchanger E17, the refrigerant performs heat exchange with return water of supplied hot water from the fan coil unit E21 and fresh air heat exchanger E22 on the user side in the first pipe of the first ground source heat pump heat exchanger and is then cooled down to liquefy it into a liquid refrigerant, and then the liquid refrigerant flows into the throttle valve E20, the liquid refrigerant expands into a gas-liquid two-phase mixed refrigerant after throttling by the throttle valve E20, the gas-liquid two-phase mixed refrigerant enters the first pipe of the second ground source heat pump heat exchanger E19, is heated after absorbing, in the second ground source heat pump heat exchanger E19, heat from circulating return water of the soil source heat exchanger E9 in the second pipe of the heat pump heat exchanger, and the gas-liquid two-phase mixed refrigerant is heated into superheated refrigerant vapor, and the superheated refrigerant vapor returns to the ground source heat pump unit compressor E18, so that the heating cycle of the ground source heat pump unit is completed.

The user-side heating cycle includes the following steps:

Return water of supplied hot water from the fan coil unit E21 and the fresh air heat exchanger E22 on the user side enters a first pipe of the heat pump heat exchanger E17 and is heated after heat exchange with a gaseous refrigerant in a second pipe of the heat pump heat exchanger, and supplied hot water flows out from the first pipe of the heat pump heat exchanger E17, and enters, under the pressurization of the fifth water pump P5, the fan coil unit E21 and the fresh air heat exchanger E22 on the user side through a fan coil unit heat exchange pipeline for heat exchange, and then supplied hot water after heat exchange returns to the first pipe of the heat pump heat exchanger E17, so that the user-side heating cycle is completed.

The domestic hot water supply includes the following steps:

High-temperature refrigerant in the solar energy heat collector E1 enters the upper heat collection coil unit E2 to heat exchange with stored hot water at an upper part of the heat collection tank E6, and is then cooled down to obtain a cooled high-temperature refrigerant, the cooled high-temperature refrigerant returns to the solar energy heat collector E1 under the pressurization of the first water pump P1; the stored hot water in the heat collection tank E6 is heated by the upper heat collection coil unit E2; when driven by the second water pump P2, high-temperature stored hot water at the top of the heat collection tank E6 enters the bottom of the heating water storage tank E7, and low-temperature stored hot water at the bottom of the heating water storage tank E7 enters the top of the heat collection tank E6 through a lower circulating water outlet, so that high-grade heat energy of the heat collection tank E6 is transferred to the heating water storage tank E7; circulating water at an upper part of the heating water storage tank E7 enters the gas-fired heating and hot water combi-boiler E20 under the pressurization of the seventh water pump P7 and is heated after heat exchange with a high-temperature flue gas in the gas-fired heating and hot water combi-boiler E20, and heated circulating water returns to the heating water storage tank E7; and domestic tap water enters a second heat taking coil unit E4 and is heated after heat exchange with stored hot water in the middle of the heating water storage tank E7, and heated tap water is transferred to the user, to meet the domestic hot water demand of users, so that the domestic hot water supply is completed.

The ground source heat pump heating mode with gas heat complementing includes the following steps:

Controlling the water pumps and valves to disconnect between the ground source heat pump cooling/heating unit, the lithium bromide absorptive refrigeration unit, and the indirect evaporative cooling waste heat recovery unit, disconnect between the multi-level management unit for heat sources, the lithium bromide absorptive refrigeration unit, and the gas heat complementing unit; connect the ground source heat pump cooling/heating unit, the multi-level management unit for heat sources, and the gas heat complementing unit, to form heating cycle of the ground source heat pump unit, heating cycle on the user side, and domestic hot water supply. Steps for controlling the valves and pumps are as follows:

Closing the third valve V3, the fourth valve V4, the seventh valve V7, the eighth valve V8, the ninth valve V9, the eleventh valve V11, the twelfth valve V12, the fourteenth valve V14, the eighteenth valve V18, and the nineteenth valve V19; opening the first valve V1, the second valve V2, the fifth valve V5, the sixth valve V6, the tenth valve V10, the thirteenth valve V13, the fifteenth valve V15, the sixteenth valve V16, and the seventeenth valve V17; starting the first water pump P1, the second water pump P2, the fifth water pump P5, and the sixth water pump P6; operating the annular ground source heat pump unit and the gas-fired heating and hot water combi-boiler E20; and performing combined heating by the gas-fired heating and hot water combi-boiler E20 and the ground source heat pump unit, ensuring system heating stability and meeting user comfort requirements.

Steps of heating cycle of the ground source heat pump unit in the gas heat complementing-ground source heat pump heating mode are the same as steps of the heating cycle of the ground source heat pump unit in the ground source heat pump heating mode.

The user-side heating cycle includes the following steps:

Return water of supplied hot water from the fan coil unit E21 and the fresh air heat exchanger E22 on the user side enters a first pipe of the first ground source heat pump heat exchanger E17 and is heated after heat exchange with a gaseous refrigerant in a second pipe of the first ground source heat pump heat exchanger, and heated supplied hot water flows out from the first pipe of the first ground source heat pump heat exchanger E17, enters the gas-fired heating and hot water combi-boiler E20 through heat complementing circulation pipelines under the pressurization of the fifth water pump P5, and is heated again after heat exchange with a high-temperature flue gas, and heated supplied hot water of more than 45° C. flows out from the gas-fired heating and hot water combi-boiler E20 and enters the fan coil unit E21 and the fresh air heat exchanger E22 on the user side for heat exchange, and then the hot water after heat exchange returns to the first pipe of the first ground source heat pump heat exchanger E17, so that the user-side heating cycle is completed.

The domestic hot water supply includes the following steps:

A high-temperature refrigerant in the solar energy heat collector E1 enters the upper heat collection coil unit E2 and is cooled down after heat exchange with stored hot water at an upper part of the heat collection tank E6, and a cooled high-temperature refrigerant returns to the solar energy heat collector E1 under the pressurization of the first water pump P1; the stored hot water in the heat collection tank is heated by the upper heat collection coil unit E2; when driven by the second water pump P2, high-temperature stored hot water at the top of the heat collection tank E6 enters the bottom of the heating water storage tank E7, and low-temperature stored hot water at the bottom of the heating water storage tank E7 enters the top of the heat collection tank E6 through a lower circulating water outlet, so that high-grade heat energy of the heat collection tank E6 is transferred to the heating water storage tank E7; domestic tap water enters a second heat taking coil unit E4 and is heated after heat exchange with stored hot water in the middle of the heating water storage tank E7, and heated tap water is transferred to the user, to meet the domestic hot water demand of users, so that the domestic hot water supply is completed.

Embodiments

The refrigeration cycle of the ground source heat pump unit includes the following steps:

The ground source heat pump unit compressor E18 compresses a gaseous refrigerant at the temperature ranging from −10° C. to 10° C. (such as −10° C., 5° C., 10° C.) into a gaseous refrigerant at the temperature ranging from 55° C. to 75° C. (such as 55° C., 60° C., 75° C.), and the compressed refrigerant flows into the second ground source heat pump heat exchanger E19 and is cooled down after heat exchange with return water of circulating water from the soil source heat exchanger E9 and liquefied into a liquid refrigerant at the temperature ranging from 40° C. to 55° C. (such as 40° C., 45° C., 55° C.), then the liquid refrigerant flows into the throttle valve E20, the liquid refrigerant expands into a gas-liquid two-phase mixed refrigerant at the temperature ranging from −15° C. to 5° C. (such as −15° C., 0° C., 5° C.) after throttling by the throttle valve E20, the gas-liquid two-phase mixed refrigerant enters the first ground source heat pump heat exchanger E17, and is heated after absorbing heat of cooling circulation return water on the user in the first ground source heat pump heat exchanger E17, and the gas-liquid two-phase mixed refrigerant becomes superheated refrigerant vapor at the temperature ranging from −10° C. to 10° C. (such as 10° C., 5° C., 10° C.), and the superheated vapor finally returns to the ground source heat pump unit compressor E18, so that heating cycle of the ground source heat pump unit is completed.

The waste heat recovery cycle includes the following steps (an internal structure of the indirect evaporative cooler is shown in FIG. 3):

Cooling water at the temperature ranging from 20° C. to 22° C. (such as 20° C., 21° C., 22° C.) flowing out from a wet channel outlet of the indirect evaporative cooler E24 enters the cooling complementing heat exchanger E23 and is cooled down to the temperature ranging from 16° C. to 18° C. (such as 16° C., 17° C., 18° C.) after heat exchange with chilled water in a cooling taking side pipeline in a cooling complementing heat exchanger E23, and chilled cooling water enters a wet channel of the indirect evaporative cooler E24 under the pressurization of the eighth water pump P8, performs direct heat-wet exchange with building's indoor exhaust air with a relative humidity in a range of 30-50% (such as 30%, 40%, 50%) and a temperature ranging from 24° C. to 26° C. (such as 24° C., 25° C., 26° C.) in the wet channel, and performs indirect heat-exchange with outside fresh air with a relative humidity in a range of 60-90% (such as 60%, 80%, 90%) and a temperature ranging from 30° C. to 38° C. (such as 30° C., 35° C., 38° C.) in a dry channel on the other side (the change in an air state is shown in a enthalpy and wetness diagram of FIG. 4); then cooling water through the indirect heat exchange flows out from the wet channel outlet of the indirect evaporative cooler and returns to the cooling complementing heat exchanger E23, so that the waste heat recovery cycle is completed.

The user-side chilled water cycle includes the following steps:

Chilled water of return water at approximately 12° C. flowing out from the cooling complementing heat exchanger E23, the fan coil unit E21, and the fresh air heat exchanger E22 enters a first pipe of the first ground source heat pump heat exchanger E17 and is cooled down after heat exchange with a gas-liquid two-phase mixed refrigerant in a second pipe of the first ground source heat pump heat exchanger, and then chilled water at approximately 7° C. flowing out from a first tube side outlet of the first ground source heat pump heat exchanger E17 returns to the fan coil unit E21, the fresh air heat exchanger E22, and the cooling complementing heat exchanger E23 on the user side again under the pressurization of the fifth water pump P5, so that the user-side chilled water circulation is completed.

The domestic hot water supply includes the following steps:

A high-temperature refrigerant at approximately 80° C. to 120° C. (such as 80° C., 100° C., 120° C.) in the solar energy heat collector E1 enters an upper heat collection coil unit E2 and is cooled down to the temperature ranging from 60° C. to 70° C. (such as 60° C., 65° C., 70° C.) after heat exchange with stored hot water at an upper part in the heat collection tank E6, and then returns to the solar energy heat collector E1 under the pressurization of the water pump P1. The stored hot water in the heat collection tank is heated by a heat collection coil unit; when driven by the second water pump P2, high-temperature stored hot water at the temperature ranging from 60° C. to 90° C. (such as 60° C., 80° C., 90° C.) at the top of the heat collection tank E6 enters the bottom of the heating water storage tank E7 through a lower circulating water inlet of the heating water storage tank E7, and low-temperature stored hot water at a temperature less than 50° C. at the bottom of the heating water storage tank E6 enters the top of the heat collection tank E6 through a lower circulating water outlet, so that high-grade heat energy of the heat collection tank E6 is transferred to the heating water storage tank E7; and domestic tap water enters a second heat taking coil unit E4 and is heated after heat exchange with stored hot water in the middle of the heating water storage tank E7, and heated tap water at the temperature ranging from 50° C. to 60° C. (such as 50° C., 55° C., 60° C.) is transferred to the user to meet the domestic hot water demand of users.

The refrigeration cycle of the ground source heat pump unit includes the following steps:

The ground source heat pump unit compressor E18 compresses refrigerant vapor at the temperature ranging from −10° C. to 10° C. (such as −10° C., 5° C., 10° C.) into refrigerant vapor at the temperature ranging from 55° C. to 75° C. (such as 55° C., 70° C., 75° C.), and the compressed refrigerant flows into the second ground source heat pump heat exchanger E19 and is cooled down after heat exchange with return water of circulating water from the lower heat collection coil unit E25 and liquefied into a liquid refrigerant at 40° C.-55° C. (such as 40° C., 45° C., 55° C.), then the liquid refrigerant flows into the throttle valve E20, the liquid refrigerant expands into a gas-liquid two-phase mixed refrigerant at the temperature ranging from −15° C. to 5° C. (such as −15° C., −10° C., 5° C.) after throttling by the throttle valve E20, the gas-liquid two-phase mixed refrigerant enters a second pipe of the first ground source heat pump heat exchanger E17, and is heated after heat exchange in the first ground source heat pump heat exchanger E17 with heat of cooling circulation return water on the user in the first pipe, and the gas-liquid two-phase mixed refrigerant becomes superheated refrigerant vapor at the temperature ranging from −10° C. to 10° C. (such as 10° C., 6° C., 10° C.), and the superheated vapor finally returns to the ground source heat pump unit compressor E18, so that heating cycle of the ground source heat pump unit is completed.

The refrigeration cycle of the lithium bromide absorptive refrigeration unit includes the following steps:

Refrigerant vapor at a temperature ranging from 2° C. to 5° C. (such as 2° C., 4° C., 5° C.) and an absolute pressure in a range of 0.8-0.9 kPa (such as 0.8 kPa, 0.85 kPa, 0.9 kPa) flowing out from a third refrigeration unit heat exchanger E13 enters a fourth refrigeration unit heat exchanger E14, concentrated lithium bromide solution with a mass percent of 58-64% (such as 58%, 60%, 64%) in the fourth refrigeration unit heat exchanger E14 absorbs the refrigerant vapor from the third refrigeration unit heat exchanger E13, the concentrated lithium bromide solution is diluted into dilute lithium bromide solution with a mass percent of 50-54% (such as 50%, 52%, 54%), and heat released during absorption is taken away by the low-temperature circulating water from the heat collection tank E6 in the pipe; the dilute lithium bromide solution enters the first refrigeration unit heat exchanger E10 under the boost of a first solution pump E16, and the dilute lithium bromide solution is heated by circulating hot water at a temperature more than 75° C. from the first heat taking coil unit E8 in a heat exchanger pipe in a shell of the first refrigeration unit heat exchanger E10, in this process, a refrigerant in the dilute lithium bromide solution evaporates into refrigerant vapor, the refrigerant vapor enters a second refrigeration unit heat exchanger E11, and the dilute lithium bromide solution in the first refrigeration unit heat exchanger E10 is heated and concentrated into concentrated lithium bromide solution with a mass percent of 58-64% (such as 58%, 60%, 64%), goes through pressure reduction and throttling by a throttle valve E15, and returns to the fourth refrigeration unit heat exchanger E14; the refrigerant vapor at a temperature ranging from 75° C. to 85° C. (such as 75° C., 80° C., 85° C.) and an absolute pressure in a range of 6.5-8 kPa (such as 6.5 kPa, 7 kPa, 8 kPa) from the first refrigeration unit heat exchanger E10 is cooled and liquefied into a liquid refrigerant at a temperature ranging from 75° C. to 85° C. (such as 75° C., 80° C., 85° C.) and an absolute pressure of 6.5-8 kPa (such as 6.5 kPa, 6.8 kPa, 8 kPa) by low-temperature circulating water from a tube side outlet of the fourth refrigeration unit heat exchanger in the heat exchanger pipe in the shell of the second refrigeration unit heat exchanger E11, then the liquid refrigerant flows out from the second refrigeration unit heat exchanger E11 and goes through pressure reduction and throttling by the first throttle valve E12 to become a liquid refrigerant at a temperature ranging from 2° C. to 5° C. (such as 2° C., 4° C., 5° C.) and an absolute pressure in a range of 0.8-0.9 kPa (such as 0.8 kPa, 0.85 kPa, 0.9 kPa) to enter the third refrigeration unit heat exchanger E13, the liquid refrigerant at a temperature ranging from 2° C. to 5° C. (such as 2° C., 4° C., 5° C.) and an absolute pressure in a range of 0.8-0.9 kPa (such as 0.8 kPa, 0.85 kPa, 0.9 kPa) absorbs, in the shell of the third refrigeration unit heat exchanger E13, heat in circulating chilled water in the heat exchanger pipe, thereby being evaporated and vaporized into refrigerant vapor at a temperature ranging from 2° C. to 5° C. (such as 2° C., 4° C., 5° C.) and an absolute pressure in a range of 0.8-0.9 kPa (such as 0.8 kPa, 0.85 kPa, 0.9 kPa), and then the refrigerant vapor returns to the fourth refrigeration unit heat exchanger E14, so that refrigeration cycle of the lithium bromide refrigeration unit is completed.

Steps of the waste heat recovery cycle in the combined cooling mode of the ground source heat pump and the lithium bromide absorptive refrigeration unit are the same as steps of the waste heat recovery cycle in the ground source heat pump cooling mode.

The user-side chilled water cycle includes the following steps:

Return water of chilled water at a temperature more than 12° C. flowing out from the cooling complementing heat exchanger E23, the fan coil unit E21, and the fresh air heat exchanger E22 enters a first pipe in the first ground source heat pump heat exchanger E17 for heat exchange and cooling, and cooled chilled water at the temperature ranging from 10° C. to 12° C. (such as 10° C., 11° C., 12° C.) flows from the first ground source heat pump heat exchanger E17 to the third refrigeration unit heat exchanger E13 through the second connecting pipeline, the chilled water in a pipe of the third refrigeration unit heat exchanger E13 is cooled to approximately 7° C. by the refrigerant at the temperature ranging from 2° C. to 5° C. (such as 2° C., 4° C., 5° C.) in the shell of the heat exchanger, then cooled chilled water enters fan coil unit heat exchange circulation pipelines under the pressurization of the fifth water pump P5 and returns to the fan coil unit E21, the fresh air heat exchanger E22, and the cooling complementing heat exchanger E23 on the user side respectively, so that the user-side chilled water circulation is completed.

The high-temperature hot water supply includes the following steps:

A high-temperature refrigerant at approximately 80° C. to 110° C. (such as 80° C., 100° C., 110° C.) in the solar energy heat collector E1 enters an upper heat collection coil unit E2 and is cooled down to the temperature ranging from 60° C. to 70° C. (such as 60° C., 68° C., 70° C.) after heat exchange with stored hot water at an upper part in the heat collection tank E6, and then returns to the solar energy heat collector E1 under the pressurization of the first water pump P1; the stored hot water at the upper part of the heat collection tank E6 is heated to the temperature ranging from 60° C. to 90° C. by the upper heat collection coil unit E2; stored hot water at a lower part of the heat collection tank E6 enters a pipe of the fourth refrigeration unit heat exchanger E14 when driven by the fourth water pump P4 and is heated to the temperature ranging from 45° C. to 50° C. (such as 45° C., 48° C., 50° C.) after heat exchange with the lithium bromide solution in a shell of the fourth refrigeration unit heat exchanger, heated circulating water flows out from the fourth refrigeration unit heat exchanger E14 to a pipe of the second refrigeration unit heat exchanger E11, is heated to the temperature ranging from 50° C. to 70° C. (such as 50° C., 60° C., 70° C.) by a refrigerant at the temperature ranging from 75° C. to 85° C. (such as 75° C., 78° C., 85° C.) in a shell of the second refrigeration unit heat exchanger, and then a heated refrigerant returns to the heat collection tank E6; low-temperature circulating water at the temperature ranging from 35° C. to 45° C. (such as 35° C., 40° C., 45° C.) after heat exchange in the lower heat collection coil unit E25 at the bottom of the heat collection water tank E6 enters a second pipe of the second ground source heat pump heat exchanger E19, and is heated after heat exchange with a gaseous refrigerant at the temperature ranging from 55° C. to 75° C. (such as 55° C., 60° C., 75° C.) in a first pipe of the second ground source heat pump heat exchanger E19, and low-temperature circulating water heated to the temperature ranging from 45° C. to 55° C. (such as 45° C., 50° C., 55° C.) returns to the lower heat collection coil unit E25 under the pressurization of the sixth water pump P6; high-temperature stored hot water at the temperature ranging from 60° C. to 90° C. (such as 60° C., 78° C., 90° C.) at the top of the heat collection tank E6 enters the heating water storage tank E7 through a lower circulating water inlet of the heating water storage tank E7 when driven by the second water pump P2, and low-temperature stored hot water at a temperature less than 50° C. at the bottom of the heating water storage tank E7 enters the top of the heat collection tank E6 through a lower circulating water outlet, so that high-grade heat energy of the heat collection tank E6 is transferred to the heating water storage tank E7; domestic tap water enters a second heat taking coil unit E4 and is heated after heat exchange with stored hot water in the middle of the heating water storage tank E7, and heated tap water at the temperature ranging from 50° C. to 60° C. (such as 50° C., 56° C., 60° C.) is transferred to the user to meet the domestic hot water demand of users; high-temperature hot water at a temperature more than 75° C. in the first heat taking coil unit E8 at the top of the heating water storage tank E7 enters a pipe of the first refrigeration unit heat exchanger E10 and is cooled down to approximately 70° C. after heat exchange with the lithium bromide solution in the shell, to provide high-quality heat energy for the lithium bromide absorptive refrigeration unit; and circulating water with heat exchanged is driven by the third water pump P3 to return to the first heat taking coil unit E8, so that the supply of high-temperature hot water is completed.

Steps of refrigeration cycle of the ground source heat pump unit in the combined cooling mode for the ground source heat pump and the lithium bromide absorptive refrigeration unit with gas heat complementing are the same as the steps of the refrigeration cycle of the ground source heat pump unit in the combined cooling mode for the ground source heat pump and the lithium bromide absorptive refrigeration unit.

Steps of refrigeration cycle of the lithium bromide absorptive refrigeration unit in the combined cooling mode for the ground source heat pump and the lithium bromide absorptive refrigeration unit with gas heat complementing are the same as the steps of the refrigeration cycle of the lithium bromide absorptive refrigeration unit in the combined cooling mode for the ground source heat pump and the lithium bromide absorptive refrigeration unit.

Steps of the waste heat recovery cycle in the combined cooling mode of the ground source heat pump and the lithium bromide absorptive refrigeration unit with gas heat complementing are the same as steps of the waste heat recovery cycle in the ground source heat pump cooling mode.

Steps of user-side chilled water circulation in the combined cooling mode for the ground source heat pump and the lithium bromide absorptive refrigeration unit with gas heat complementing are the same as steps of user-side chilled water circulation in the ground source heat pump cooling mode.

The high-temperature hot water supply includes the following steps:

A high-temperature refrigerant at approximately 60° C. to 80° C. (such as 60° C., 78° C., 80° C.) in a solar energy heat collector E1 enters an upper heat collection coil unit E2 and is cooled down to the temperature ranging from 50° C. to 60° C. (such as 50° C., 55° C., 60° C.) after heat exchange with stored hot water at an upper part in the heat collection tank E6, and then returns to the solar energy heat collector E1 under the pressurization of the water pump P1; the stored hot water in the heat collection tank E6 is heated to the temperature ranging from 50° C. to 70° C. (such as 50° C., 60° C., 70° C.) by the upper heat collection coil unit E2; stored hot water at a lower part of the heat collection tank E6 enters a pipe of the fourth refrigeration unit heat exchanger E14 when driven by the fourth water pump P4 and is heated after heat exchange with the lithium bromide solution in a shell of the fourth refrigeration unit heat exchanger, circulating water heated to the temperature ranging from 45° C. to 50° C. (such as 45° C., 48° C., 50° C.) flows out from the fourth refrigeration unit heat exchanger E14 into a pipe of the second refrigeration unit heat exchanger E11, is heated again by a gaseous refrigerant at the temperature ranging from 75° C. to 85° C. (such as 75° C., 80° C., 85° C.) in a shell of the second refrigeration unit heat exchanger, and then the heated circulating water at the temperature ranging from 50° C. to 70° C. (such as 50° C., 60° C., 70° C.) returns to the heat collection tank E6; low-temperature circulating water at the temperature ranging from 35° C. to 45° C. (such as 35° C., 40° C., 45° C.) in the lower heat collection coil unit E25 at the bottom of the heat collection water tank E6 enters a second pipe of the second ground source heat pump heat exchanger E19, and is heated after heat exchange with a gaseous refrigerant at the temperature ranging from 55° C. to 75° C. (such as 55° C., 60° C., 75° C.) in a first pipe of the second ground source heat pump heat exchanger, and low-temperature circulating water heated to the temperature ranging from 45° C. to 55° C. (such as 45° C., 48° C., 55° C.) returns to the lower heat collection coil unit E25 under the pressurization of the sixth water pump P6; when driven by the second water pump P2, high-temperature stored hot water at the temperature ranging from 50° C. to 70° C. (such as 50° C., 65° C., 70° C.) at the top of the heat collection tank E6 enters the bottom of the heating water storage tank E7, and low-temperature stored hot water at a temperature less than 50° C. at the bottom of the heating water storage tank E7 enters the top of the heat collection tank E6 through a lower circulating water outlet of the heating water storage tank E7, so that high-grade heat energy of the heat collection tank E6 is transferred to the heating water storage tank E7; and circulating water at an upper part of the heating water storage tank E7 enters the gas-fired heating and hot water combi-boiler E20 through the heat complementing circulation pipelines under the pressurization of the seventh water pump P7 and is heated after heat exchange with a high-temperature flue gas in the gas-fired heating and hot water combi-boiler E20, and heated circulating water at 80° C. returns to the heating water storage tank E7; domestic tap water enters a second heat taking coil unit E4 and is heated after heat exchange with stored hot water in the middle of the heating water storage tank E7, and heated tap water at 50° C. to 60° C. (such as 50° C., 55° C., 60° C.) is transferred to the user to meet the domestic hot water demand of users; high-temperature hot water at a temperature more than 75° C. in the first heat taking coil unit E8 at the top of the heating water storage tank E7 enters a pipe of the first refrigeration unit heat exchanger E10, to provide high-quality heat energy for the first refrigeration unit heat exchanger; circulating water after heat exchange is driven by the third water pump P3 to be back to the first heat collection coil unit E8, so that high-temperature hot water supply is completed.

The heating cycle of the ground source heat pump unit includes the following steps:

The ground source heat pump unit compressor E18 compresses a gaseous refrigerant at the temperature ranging from −5° C. to 10° C. (such as −5° C., 5° C., 10° C.) into a gaseous refrigerant at the temperature ranging from 60° C. to 80° C. (such as 60° C., 65° C., 80° C.), the compressed refrigerant flows into a second pipe of the first ground source heat pump heat exchanger E17, after the refrigerant performs heat exchange with return water of supplied hot water from the fan coil unit E21 and fresh air heat exchanger E22 on the user side in the first pipe of the first ground source heat pump heat exchanger, and is then cooled down to liquefy it into a liquid refrigerant at the temperature ranging from 45° C. to 55° C. (such as 45° C., 50° C., 55° C.), and then the liquid refrigerant flows into the throttle valve E20, the liquid refrigerant expands into a gas-liquid two-phase mixed refrigerant at the temperature ranging from −10° C. to 5° C. (such as −10° C., 0° C., 5° C.) after throttling by the throttle valve E20, the gas-liquid two-phase mixed refrigerant enters the first pipe of the second ground source heat pump heat exchanger E19, is heated after absorbing, in the second ground source heat pump heat exchanger E19, heat from circulating return water of the soil source heat exchanger E9 in the second pipe of the heat pump heat exchanger, and the gas-liquid two-phase mixed refrigerant is heated into superheated refrigerant vapor at the temperature ranging from −5° C. to 10° C. (such as −5° C., 0° C., 10° C.), and the superheated refrigerant vapor returns to the ground source heat pump unit compressor E18, so that the heating cycle of the ground source heat pump unit is completed.

The user-side heating cycle includes the following steps:

Return water of supplied hot water at approximately 40° C. from the fan coil unit E21 and the fresh air heat exchanger E22 on the user side enters a first pipe of the first ground source heat pump heat exchanger E17 and is heated after heat exchange with a gaseous refrigerant at the temperature ranging from 60° C. to 80° C. (such as 60° C., 70° C., 80° C.) in a second pipe of the first ground source heat pump heat exchanger, and supplied hot water at approximately 45° C. flows out from the first pipe of the heat pump heat exchanger E17, and enters, under the pressurization of the fifth water pump P5, the fan coil unit E21 and the fresh air heat exchanger E22 on the user side through a fan coil unit heat exchange pipeline for heat exchange, and then supplied hot water after heat exchange returns to the first pipe of the first ground source heat pump heat exchanger E17, so that the user-side heating cycle is completed.

The domestic hot water supply includes the following steps:

A high-temperature refrigerant at approximately 50° C. to 80° C. (such as 50° C., 70° C., 80° C.) in a solar energy heat collector E1 enters an upper heat collection coil unit E2 and is cooled down to the temperature ranging from 45° C. to 60° C. (such as 45° C., 50° C., 60° C.) after heat exchange with stored hot water at an upper part in the heat collection tank E6, and then returns to the solar energy heat collector E1 under the pressurization of the first water pump P1; the stored hot water in the heat collection tank E6 is heated to the temperature ranging from 45° C. to 65° C. (such as 45° C., 50° C., 65° C.) by an upper heat collection coil unit E2; when driven by the second water pump P2, the high-temperature stored hot water at a temperature in a range of 45° C. to 65° C. (such as 45° C., 50° C., 65° C.) at the top of the heat collection tank E6 enters the bottom of the heating water storage tank E7, and low-temperature stored hot water at a temperature less than 40° C. at the bottom of the heating water storage tank E7 enters the top of the heat collection tank E6 through a lower circulating water outlet, so that high-grade heat energy of the heat collection tank E6 is transferred to the heating water storage tank E7; and circulating water at a temperature in a range of 40° C. to 60° C. (such as 40° C., 50° C., 60° C.) at an upper part of the heating water storage tank E7 enters the gas-fired heating and hot water combi-boiler E20 under the pressurization of the seventh water pump P7 and is heated to approximately 70° C. after heat exchange with a high-temperature flue gas in the gas-fired heating and hot water combi-boiler E20, and the heated circulating water returns to the heating water storage tank E7; and domestic tap water enters a second heat taking coil unit E4 and is heated after heat exchange with stored hot water in the middle of the heating water storage tank E7, and heated tap water at the temperature ranging from 50° C. to 60° C. (such as 50° C., 55° C., 60° C.) is transferred to the user to meet the domestic hot water demand of users, so that domestic hot water supply is completed.

Steps of heating cycle of the ground source heat pump unit in the gas heat complementing-ground source heat pump heating mode are the same as steps of the heating cycle of the ground source heat pump unit in the ground source heat pump heating mode.

The user-side heating cycle includes the following steps:

Return water of supplied hot water at a temperature less than 40° C. from the fan coil unit E21 and the fresh air heat exchanger E22 on the user side enters a first pipe of the first ground source heat pump heat exchanger E17 and is heated after heat exchange with a gaseous refrigerant at the temperature ranging from 60° C. to 80° C. (such as 60° C., 70° C., 80° C.) in a second pipe of the first ground source heat pump heat exchanger, and supplied hot water that is heated to the temperature ranging from 40° C. to 44° C. (such as 40° C., 41° C., 44° C.) flows out from the first pipe of the first ground source heat pump heat exchanger E17, enters the gas-fired heating and hot water combi-boiler E20 through heat complementing circulation pipelines under the pressurization of the fifth water pump P5, and is heated again after heat exchange with a high-temperature flue gas, and heated supplied hot water at a temperature more than 45° C. flows out from the gas-fired heating and hot water combi-boiler E20 and enters the fan coil unit E21 and the fresh air heat exchanger E22 on the user side for heat exchange, and then the hot water after heat exchange returns to the first pipe of the first ground source heat pump heat exchanger E17, so that the user-side heating cycle is completed.

The domestic hot water supply includes the following steps:

A high-temperature refrigerant at approximately 50° C. to 80° C. (such as 60° C., 70° C., 80° C.) in a solar energy heat collector E1 enters an upper heat collection coil unit E2 and is cooled down to the temperature ranging from 40° C. to 55° C. (such as 40° C., 45° C., 55° C.) after heat exchange with stored hot water at an upper part in the heat collection tank E6, and then returns to the solar energy heat collector E1 under the pressurization of the first water pump P1; the stored hot water in the heat collection tank is heated to the temperature ranging from 45° C. to 65° C. (such as 45° C., 50° C., 65° C.) by the upper heat collection coil unit E2; when driven by the second water pump P2, high-temperature stored hot water at the temperature ranging from 50° C. to 80° C. (such as 50° C., 70° C., 80° C.) at the top of the heat collection tank E6 enters the bottom of the heating water storage tank E7, and low-temperature stored hot water at a temperature less than 40° C. at the bottom of the heating water storage tank E7 enters the top of the heat collection tank E6 through a lower circulating water outlet, so that high-grade heat energy of the heat collection tank E6 is transferred to the heating water storage tank E7; and domestic tap water enters a second heat taking coil unit E4 and is heated after heat exchange with stored hot water in the middle of the heating water storage tank E7, and heated tap water at the temperature ranging from 40° C. to 60° C. (such as 40° C., 50° C., 60° C.) is transferred to the user to meet the domestic hot water demand of users, so that domestic hot water supply is completed.

The above description is only a preferred embodiment of the present disclosure and is not used to limit the present disclosure. Any modifications, equivalent substitutions, improvements, and the like made within the spirit and principle of the present disclosure should be included within the protection scope of the present disclosure.

What is claimed is:

1. A multi-energy coupled cooling/heating system for buildings in a long-term cooling region, including a multi-level management unit for heat sources, a solar energy heat collection unit, a lithium bromide absorptive refrigeration unit, a gas heat complementing unit, a ground source heat pump cooling/heating unit, and an indirect evaporative cooling waste heat recovery unit; the multi-level management unit for heat sources is respectively connected to the solar energy heat collection unit, the lithium bromide absorptive refrigeration unit, the gas heat complementing unit, and the ground source heat pump cooling/heating unit; the ground source heat pump cooling/heating unit is respectively connected to the lithium bromide absorptive refrigeration unit, the gas heat complementing unit, and the indirect evaporative cooling waste heat recovery unit;

the lithium bromide absorptive refrigeration unit includes a first refrigeration unit heat exchanger (E10), a first shell side outlet of the first refrigeration unit heat exchanger (E10) is successively connected to a shell side inlet of a second refrigeration unit heat exchanger (E11), a shell side outlet of the second refrigeration unit heat exchanger (E11), a first throttle valve (E12), a shell side inlet of a third refrigeration unit heat exchanger (E13), a shell side outlet of the third refrigeration unit heat exchanger (E13), a shell side inlet of a fourth refrigeration unit heat exchanger (E14), a shell side outlet of the fourth refrigeration unit heat exchanger (E14), a first solution pump (E16), and a shell side inlet of the first refrigeration unit heat exchanger (E10) through refrigeration circulation pipelines; a second outlet of the first refrigeration unit heat exchanger (E10) is connected to a second shell side inlet of the fourth refrigeration unit heat exchanger through a back-flow pipeline provided with a throttle valve (E15); the first refrigeration unit heat exchanger (E10), the second refrigeration unit heat exchanger (E11), the third refrigeration unit heat exchanger (E13), and the fourth refrigeration unit heat exchanger (E14) are connected in series to form an annular lithium bromide absorptive refrigeration unit; an outlet of a fan coil unit (E21) is successively connected to a first tube side inlet of a first ground source heat pump heat exchanger (E17), a first tube side outlet of the first ground source heat pump heat exchanger (E17), a tenth valve (V10), a fifth water pump (P5), a fourteenth valve (V14), a sixteenth valve (V16), and an inlet of the fan coil unit (E21) through fan coil unit heat exchange circulation pipelines; an inlet of a first connecting pipeline installed with a ninth valve (V9) communicates with fan coil unit heat exchange circulation pipelines between the first tube side outlet of the first ground source heat pump heat exchanger (E17) and the tenth valve (V10), and an outlet of the first connecting pipeline is connected to a tube side inlet of the third refrigeration unit heat exchanger (E13); an inlet of a second connecting pipeline is connected to a tube side outlet of the third refrigeration unit heat exchanger (E13), and an outlet of the second connecting pipeline communicates with fan coil unit heat exchange circulation pipelines between the tenth valve (V10) and the fifth water pump (P5);

the ground source heat pump cooling/heating unit includes a second tube side outlet of the first ground source heat pump heat exchanger (E17), a ground source heat pump unit compressor (E18), a first tube side inlet of a second ground source heat pump heat exchanger (E19), a first tube side outlet of the second ground source heat pump heat exchanger (E19), a second throttle valve (E20), and a second tube side inlet of the first ground source heat pump heat exchanger (E17) that are sequentially connected through soil source circulation pipelines; the first ground source heat pump heat exchanger (E17), the compressor (E18), the second ground source heat pump heat exchanger (E19), and the second throttle valve (E20) are connected in series to form an annular ground source heat pump unit; a second tube side outlet of the second ground source heat pump heat exchanger (E19) is successively connected to a sixth water pump (P6), a seventh valve (V7), an inlet of a buried pipe heat exchanger (E9), an outlet of the buried pipe heat exchanger (E9), an eighth valve (V8), and a second tube side inlet of the second ground source heat pump heat exchanger (E19) through heat pump heat exchange circulation pipelines;

one end of a third connecting pipeline is connected to an inlet of a fresh air heat exchanger (E22), and the other end communicates with fan coil unit circulation pipelines between the fourteenth valve and the sixteenth valve (V16); one end of a fourth connecting pipeline is connected to an outlet of the fresh air heat exchanger (E22), and the other end communicates with fan coil unit heat exchange circulation pipelines between a first tube side inlet of the first ground source heat pump heat exchanger (E17) and an outlet of a fan coil unit;

the gas heat complementing unit includes a gas-fired heating and hot water combi-boiler, and the multi-level management unit for heat sources includes a heating water tank (E7); a heat complementing hot water outlet of the heating water storage tank (E7) is successively connected to a seventh water pump (P7), a twelfth valve (V12), a heating inlet of the gas-fired heating and hot water combi-boiler, a heating outlet of the gas-fired heating and hot water combi-boiler, a fifteenth valve (V15), an eleventh valve (V11), and a heat complementing hot water inlet of the heating water storage tank (E7) through heat complementing circulation pipelines; one end of a fifth connecting pipeline communicates with heat complementing circulation pipelines between a fifteenth valve (V15) and the eleventh valve, and the other end communicates with fan coil unit heat exchange circulation pipelines between a fourteenth valve (V14) and the sixteenth valve (V16); one end of a sixth connecting pipeline installed with a thirteenth valve (V13) communicates with fan coil unit heat exchange circulation pipelines between the fourteenth valve (V14) and the fifth water pump, and the other end communicates with heat complementing circulation pipelines between the twelfth valve and the heating inlet of the gas-fired heating and hot water combi-boiler;

the indirect evaporative cooling waste heat recovery unit includes an indirect evaporative cooler (E24) and a cooling complementing heat exchanger (E23); a wet channel outlet of the indirect evaporative cooler is successively connected to an inlet of a refrigeration side pipeline of the cooling complementing heat exchanger, an outlet of the refrigeration side pipeline, an eighth water pump (V8), and a wet channel inlet of the indirect evaporative cooler (E24) through a cooling circulation pipeline; an inlet of a cooling taking side pipeline of the cooling complementing heat exchanger communicates with fan coil unit heat exchange circulation pipelines between the fifth water pump (P5) and the fourteenth valve (V14) through a seventh connecting pipeline installed with an eighteenth valve (V18), and an outlet of the cooling taking side pipeline of the cooling complementing heat exchanger (E23) communicates with a-fan coil unit heat exchange circulation pipelines between a first tube side inlet of the first ground source heat pump heat exchanger and an outlet of a fan coil unit through an eighth connecting pipeline installed with a nineteenth valve (V19); a dry channel inlet of the indirect evaporative cooler (E24) communicates with outdoor fresh air, and a dry channel outlet is connected to an air inlet of the fresh air heat exchanger (E22);

the multi-level management unit for heat sources includes a heat collection tank (E6) and the heating water storage tank (E7); an upper circulating water outlet at the top of the heat collection tank (E6) is successively connected to a second water pump (P2), a second valve (V2), and a lower circulating water inlet at the bottom of the heating water storage tank (E7) through a ninth connecting pipeline; a lower circulating water outlet at the bottom of the heating water storage tank (E7) is connected to a first valve (V1) and an upper circulating water inlet at the top of the heat collection tank (E6) through a tenth connecting pipeline; an outlet of a second heat taking coil unit installed in the middle of the heating water storage tank (E7) is connected to a domestic water end (E3);

the solar energy heat collection unit includes a solar energy heat collector (E1) and an upper heat collection coil unit at an inner top of the heat collection tank, and an outlet of the solar energy heat collector is connected to an inlet of the upper heat collection coil unit, after heat exchange with hot water stored in the heat collection tank, an outlet of the heat collection coil unit is connected to an inlet of the solar energy heat collector through a first water pump, and a lower heat collection coil unit (E25) is disposed below the inside of the heat collection tank (E6);

a connection structure of the lithium bromide absorptive refrigeration unit and the multi-level management unit for heat sources is as follows: a heat collection hot water outlet at a lower part of the heat collection tank (E6) is successively connected to a fourth water pump (P4), a third valve (V3), and a tube side inlet of a fourth refrigeration unit heat exchanger through an eleventh connecting pipeline; a tube side outlet of the fourth refrigeration unit heat exchanger (E14) is connected to a tube side inlet of a second refrigeration unit heat exchanger (E11), a tube side outlet of the second refrigeration unit heat exchanger (E11), a fourth valve (V4), and a heat collection hot water inlet at a lower part of the heat collection tank (E6); a tube side outlet of the first refrigeration unit heat exchanger (E10) is successively connected to a third water pump and an inlet of a first heat taking coil unit at an inner top of the heating water storage tank (E7) through a twelfth connecting pipeline; an outlet of the first heat taking coil unit is connected to a tube side inlet of the first refrigeration unit heat exchanger (E10);

connection between the ground source heat pump cooling/heating unit and the multi-level management unit for heat sources is as follows: an outlet of a lower heat collection coil unit (E25) communicates with heat pump heat exchange circulation pipelines between the eighth valve and a second tube side inlet of the second ground source heat pump heat exchanger (E19) through a nineteenth connecting pipeline installed with a sixth valve (V6); an inlet of the lower heat collection coil unit (E25) communicates with heat pump heat exchange circulation pipelines between the seventh valve and the sixth water pump through a twentieth connecting pipeline installed with a fifth valve (V5).

2. An operation method for the multi-energy coupled cooling/heating system according to claim 1, wherein the operation method includes a cooling mode and a heating mode; the cooling mode includes a ground source heat pump cooling mode, a combined cooling mode of a ground source heat pump and a lithium bromide absorptive refrigeration unit, and a combined cooling mode of the ground source heat pump and the lithium bromide absorptive refrigeration unit with gas heat complementing;

the ground source heat pump cooling mode comprises the following control process:

controlling valves and water pumps to: disconnect between the ground source heat pump cooling/heating unit, the multi-level management unit for heat sources, the lithium bromide absorptive refrigeration unit, and the gas heat complementing unit; disconnect between the multi-level management unit for heat sources, the lithium bromide absorptive refrigeration unit, and the gas heat complementing unit; and connect the ground source heat pump cooling/heating unit and the indirect evaporative cooling waste heat recovery unit, to form refrigeration cycle and a waste heat recovery cycle of the ground source heat pump unit, and chilled water circulation and domestic hot water supply for users; the control process of the valves and water pumps is as follows:

closing the third valve (V3), the fourth valve (V4), the fifth valve (V5), the sixth valve (V6), the ninth valve (V9), the eleventh valve (V11), the twelfth valve (V12), the thirteenth valve (V13), and the fifteenth valve (V15); opening the first valve (V1), the second valve (V2), the seventh valve (V7), the eighth valve (V8), the tenth valve (V10), the fourteenth valve (V14), the sixteenth valve (V16), a seventeenth valve (V17), the eighteenth valve (V18), and the nineteenth valve (V19); and starting the first water pump (P1), the second water pump (P2), the fifth water pump (P5), the sixth water pump (P6), and the eighth water pump (P8); operating an annular ground source heat pump unit;

the combined cooling mode of the ground source heat pump and the lithium bromide absorptive refrigeration unit is as follows:

controlling valves and water pumps to: disconnect between the gas heat complementing unit and the ground source heat pump cooling/heating unit; connect the ground source heat pump cooling/heating unit and the lithium bromide absorptive refrigeration unit; and connect the multi-level management unit for heat sources, the ground source heat pump cooling/heating unit, and the lithium bromide absorptive refrigeration unit, to form refrigeration cycle of the ground source heat pump unit, refrigeration cycle of the lithium bromide absorptive refrigeration unit, waste heat recovery cycle, and chilled water circulation and high-temperature hot water supply on the user side control of the valves and water pumps is as follows:

closing the seventh valve (V7), the eighth valve (V8), the tenth valve (V10), the eleventh valve (V11), the twelfth valve (V12), the thirteenth valve (V13), and the fifteenth valve (V15); opening the first valve (V1), the second valve (V2), the third valve (V3), the fourth valve (V4), the fifth valve (V5), the sixth valve (V6), the ninth valve (V9), the fourteenth valve (V14), the sixteenth valve (V16), the seventeenth valve (V17), the eighteenth valve (V18), and the nineteenth valve (V19); starting the first water pump (P1), the second water pump (P2), the third water pump (P3), the fourth water pump (P4), the fifth water pump (P5), the sixth water pump (P6), and the eighth water pump (P8); and operating the annular ground source heat pump unit and the annular lithium bromide absorptive refrigeration unit;

a combined cooling mode of the ground source heat pump and the lithium bromide absorptive refrigeration unit with gas heat complementing is as follows:

controlling water pumps and valves to: disconnect between the gas heat complementing unit and the ground source heat pump cooling/heating unit; connect the multi-level management unit for heat sources, the ground source heat pump cooling/heating unit, the lithium bromide absorptive refrigeration unit, and the gas heat complementing unit; and connect the ground source heat pump cooling/heating unit and the lithium bromide absorptive refrigeration unit, to form refrigeration cycle of the ground source heat pump unit, refrigeration cycle of the lithium bromide absorptive refrigeration unit, waste heat recovery cycle, and chilled water circulation and high-temperature hot water supply on the user side; control of the water pumps and valves is as follows:

closing the seventh valve (V7), the eighth valve (V8), the tenth valve (V10), the thirteenth valve (V13), and the fifteenth valve (V15), opening the first valve (V1), the second valve (V2), the third valve (V3), the fourth valve (V4), the fifth valve (V5), the sixth valve (V6), the ninth valve (V9), the eleventh valve (V11), the twelfth valve (V12), the fourteenth valve (V14), the sixteenth valve (V16), the seventeenth valve (V17), the eighteenth valve (V18), and the nineteenth valve (V19); starting the first water pump (P1), the second water pump (P2), the third water pump (P3), the fourth water pump (P4), the fifth water pump (P5), the sixth water pump (P6), the seventh water pump (P7), and the eighth water pump (P8); and starting the gas-fired heating and hot water combi-boiler; operating the annular ground source heat pump unit and the annular lithium bromide absorptive refrigeration unit;

the heating mode includes a ground source heat pump heating mode and a gas heat complementing-ground source heat pump heating mode, and the ground source heat pump heating mode is as follows:

the ground source heat pump heating mode includes the following steps:

controlling valves and water pumps to: disconnect between the ground source heat pump cooling/heating unit, the multi-level management unit for heat sources, the lithium bromide absorptive refrigeration unit, the gas heat complementing unit, and the indirect evaporative cooling waste heat recovery unit; disconnect between the multi-level management unit for heat sources and the lithium bromide absorptive refrigeration unit; connect the multi-level management unit for heat sources and the gas heat complementing unit, to form heating cycle of the ground source heat pump unit, heating cycle on the user side, and domestic hot water supply; steps for controlling the valves and pumps are as follows:

closing the third valve (V3), the fourth valve (V4), the fifth valve (V5), the sixth valve (V6), the ninth valve (V9), the thirteenth valve (V13), the fifteenth valve (V15), the eighteenth valve (V18), and the nineteenth valve (V19); opening the first valve (V1), the second valve (V2), the seventh valve (V7), the eighth valve (V8), the tenth valve (V10), the eleventh valve (V11), the twelfth valve (V12), the fourteenth valve (V14), the sixteenth valve (V16), and the seventeenth valve (V17); starting the first water pump (P1), the second water pump (P2), the fifth water pump (P5), the sixth water pump (P6), and the seventh water pump (P7); and operating the annular ground source heat pump unit and the gas-fired heating and hot water combi-boiler (E20);

the ground source heat pump heating mode with gas heat complementing includes the following steps:

controlling the water pumps and valves to: disconnect between the ground source heat pump cooling/heating unit, the lithium bromide absorptive refrigeration unit, and the indirect evaporative cooling waste heat recovery unit, disconnect between the multi-level management unit for heat sources, the lithium bromide absorptive refrigeration unit, and the gas heat complementing unit; connect the ground source heat pump cooling/heating unit, the multi-level management unit for heat sources, and the gas heat complementing unit, to form heating cycle of the ground source heat pump unit, heating cycle on the user side, and domestic hot water supply; steps for controlling the valves and pumps are as follows:

closing the third valve (V3), the fourth valve (V4), the seventh valve (V7), the eighth valve (V8), the ninth valve (V9), the eleventh valve (V11), the twelfth valve (V12), the fourteenth valve (V14), the eighteenth valve (V18), and the nineteenth valve (V19); opening the first valve (V1), the second valve (V2), the fifth valve (V5), the sixth valve (V6), the tenth valve (V10), the thirteenth valve (V13), the fifteenth valve (V15), the sixteenth valve (V16), and the seventeenth valve (V17); starting the first water pump (P1), the second water pump (P2), the fifth water pump (P5), and the sixth water pump (P6); operating the annular ground source heat pump unit and the gas-fired heating and hot water combi-boiler (E20); performing combined heating by the gas-fired heating and hot water combi-boiler and the ground source heat pump unit.

3. The operation method according to claim 2, wherein, the refrigeration cycle of the ground source heat pump unit includes the following steps:

the ground source heat pump unit compressor (E18) compresses a low-temperature gaseous refrigerant into a high-temperature gaseous refrigerant, and the compressed refrigerant flows into the second ground source heat pump heat exchanger (E19) to heat exchange with return water of circulating water from the buried pipe heat exchanger (E9), and then is cooled down to liquefy it into a liquid refrigerant, and then the liquid refrigerant flows into a second throttle valve (E20), the liquid refrigerant expands into a gas-liquid two-phase mixed refrigerant after throttling by the second throttle valve (E20), and the gas-liquid two-phase mixed refrigerant enters the first ground source heat pump heat exchanger (E17), and is heated after absorbing heat of cooling circulation return water on the user in the first ground source heat pump heat exchanger (E17), and the gas-liquid two-phase mixed refrigerant becomes superheated refrigerant vapor, and the superheated refrigerant vapor finally returns to the ground source heat pump unit compressor (E18), so that cooling cycle of the ground source heat pump unit is completed;

the waste heat recovery cycle includes:

cooling water flows out from a wet channel outlet of the indirect evaporative cooler (E24), enters the cooling complementing heat exchanger (E23) to heat exchange with chilled water in a cooling taking side pipeline in the cooling complementing heat exchanger (E23), and then is cooled down to form chilled cooling water, chilled cooling water enters a wet channel of the indirect evaporative cooler (E24) under the pressurization of the eighth water pump (P8), performs direct heat-wet exchange with a building's indoor exhaust air in the wet channel, and performs indirect heat-exchange with outside fresh air in a dry channel on the other side; then cooling water through the indirect heat exchange flows out from the wet channel outlet of the indirect evaporative cooler and returns to the cooling complementing heat exchanger (E23), so that the waste heat recovery cycle is completed;

the user-side chilled water cycle includes:

return water of chilled water flowing out from the cooling complementing heat exchanger (E23), the fan coil unit (E21), and the fresh air heat exchanger (E22) enters a first pipe of the first ground source heat pump heat exchanger (E17) to heat exchange with a gas-liquid two-phase mixed refrigerant in a second pipe of the heat pump heat exchanger, and then is cooled down to form chilled water, the chilled water flowing out from the first tube side outlet of the first ground source heat pump heat exchanger (E17) returns to the fan coil unit (E21), the fresh air heat exchanger (E22), and the cooling complementing heat exchanger (E23) again on the user side again under the pressurization of the fifth water pump (P5), so that the user-side chilled water circulation is completed;

the domestic hot water supply includes the following steps:

a high-temperature refrigerant in a solar energy heat collector (E1) enters an upper heat collection coil unit (E2) to heat exchange with stored hot water at an upper part of the heat collection tank (E6), and then is cooled down, the cooled refrigerant returns to the solar energy heat collector (E1) under the pressurization of the first water pump (P1); the stored hot water in the heat collection tank is heated by a heat collection coil unit; when driven by the second water pump (P2), high-temperature stored hot water at the top of the heat collection tank (E6) enters the bottom of the heating water storage tank (E7) through a lower circulating water inlet of the heating water storage tank (E7), and low-temperature stored hot water at the bottom of the heating water storage tank (E7) enters the top of the heat collection tank (E6) through a lower circulating water outlet, so that high-grade heat energy of the heat collection tank (E6) is transferred to the heating water storage tank (E7); and domestic tap water enters the second heat taking coil unit (E4) and is heated after heat exchange with stored hot water in the middle of the heating water storage tank (E7), and heated tap water is transferred to the user to meet the domestic hot water demand of users.

4. The operation method according to claim 3, wherein, the refrigeration cycle of the ground source heat pump unit includes the following steps:

the ground source heat pump unit compressor (E18) compresses low-temperature refrigerant vapor into high-temperature refrigerant vapor, and the compressed refrigerant flows into the second ground source heat pump heat exchanger (E19) for heat exchange with return water of circulating water from the lower heat collection coil unit (E25), and is cooled down to liquefy it into a liquid refrigerant, then the liquid refrigerant flows into the second throttle valve (E20), the liquid refrigerant expands into a gas-liquid two-phase mixed refrigerant after throttling by the second throttle valve (E20), the gas-liquid two-phase mixed refrigerant enters a second pipe of the first ground source heat pump heat exchanger (E17), and is heated after heat exchange in the first ground source heat pump heat exchanger (E17) with heat of cooling circulation return water on the user in the first pipe, and the gas-liquid two-phase mixed refrigerant becomes superheated refrigerant vapor, and the superheated refrigerant vapor finally returns to the ground source heat pump unit compressor (E18), so that cooling cycle of the ground source heat pump unit is completed;

the refrigeration cycle of the lithium bromide absorptive refrigeration unit includes:

refrigerant vapor flowing out from the third refrigeration unit heat exchanger (E13) enters the fourth refrigeration unit heat exchanger (E14), concentrated lithium bromide solution in the fourth refrigeration unit heat exchanger (E14) absorbs the refrigerant vapor from the third refrigeration unit heat exchanger (E13), the concentrated lithium bromide solution is diluted into dilute lithium bromide solution, and heat released during absorption is taken away by the low-temperature circulating water from the heat collection tank (E6) in the pipe; the dilute lithium bromide solution enters the first refrigeration unit heat exchanger (E10) under the boost of the first solution pump (E16), and the dilute lithium bromide solution is heated by circulating hot water from the first heat taking coil unit (E8) in a heat exchanger pipe in a shell of the first refrigeration unit heat exchanger (E10), in this process, a refrigerant in the dilute lithium bromide solution evaporates into refrigerant vapor, the refrigerant vapor enters a second refrigeration unit heat exchanger (E11), and the dilute lithium bromide solution in the first refrigeration unit heat exchanger (E10) is heated and concentrated into concentrated lithium bromide solution, goes through pressure reduction and throttling by the fifteenth throttle valve (E15), and returns to the fourth refrigeration unit heat exchanger (E14); the refrigerant vapor from the first refrigeration unit heat exchanger (E10) is cooled and liquefied into a liquid refrigerant by low-temperature circulating water from a tube side outlet of the fourth refrigeration unit heat exchanger in the heat exchanger pipe in the shell of the second refrigeration unit heat exchanger (E11), then the liquid refrigerant flows out from the second refrigeration unit heat exchanger (E11) and goes through pressure reduction and throttling by the first throttle valve (E12) to become a liquid refrigerant to enter the third refrigeration unit heat exchanger (E13), in the shell of the third refrigeration unit heat exchanger (E13), the liquid refrigerant absorbs heat in circulating chilled water in the heat exchanger pipe, thereby being evaporated and vaporized into refrigerant vapor, and then the refrigerant vapor returns to the fourth refrigeration unit heat exchanger (E14), so that refrigeration cycle of the lithium bromide absorption refrigeration unit is completed;

steps of the waste heat recovery cycle in the combined cooling mode of the ground source heat pump and the lithium bromide absorptive refrigeration unit are the same as steps of the waste heat recovery cycle in the ground source heat pump cooling mode;

the user-side chilled water cycle includes the following steps:

return water of chilled water flowing out from the cooling complementing heat exchanger (E23), the fan coil unit (E21), and the fresh air heat exchanger (E22) enters a first pipe in the first ground source heat pump heat exchanger (E17) for heat exchange and cooling, and cooled chilled water flows from the first ground source heat pump heat exchanger (E17) to the third refrigeration unit heat exchanger (E13) through the second connecting pipeline, the chilled water in a pipe of the third refrigeration unit heat exchanger (E13) is cooled down by the refrigerant in the shell of the heat exchanger, then cooled chilled water enters fan coil unit heat exchange circulation pipelines under the pressurization of the fifth water pump (P5) and returns to the fan coil unit (E21), the fresh air heat exchanger (E22), and the cooling complementing heat exchanger (E23) on the user side respectively, so that the user-side chilled water circulation is completed;

the high-temperature hot water supply includes the following steps:

a high-temperature refrigerant in the solar energy heat collector (E1) enters an upper heat collection coil unit (E2) and is cooled down after heat exchange with stored hot water at an upper part in the heat collection tank (E6), and then returns to the solar energy heat collector (E1) under the pressurization of the first water pump (P1); the stored hot water at the upper part of the heat collection tank (E6) is heated by the upper heat collection coil unit (E2); stored hot water at a lower part of the heat collection tank (E6) enters a pipe of the fourth refrigeration unit heat exchanger (E14) when driven by the fourth water pump (P4) and is heated after heat exchange with the lithium bromide solution in a shell of the fourth refrigeration unit heat exchanger, heated circulating water flows out from the fourth refrigeration unit heat exchanger (E14) to a pipe of the second refrigeration unit heat exchanger (E11), is heated by a refrigerant in a shell of the second refrigeration unit heat exchanger, and then a heated refrigerant returns to the heat collection tank (E6); low-temperature circulating water after heat exchange in the lower heat collection coil unit (E25) at the bottom of the heat collection water tank (E6) enters a second pipe of the second ground source heat pump heat exchanger (E19), and is heated after heat exchange with a gaseous refrigerant in a first pipe of the second ground source heat pump heat exchanger (E19), and heated circulating water returns to the lower heat collection coil unit (E25) under the pressurization of the sixth water pump (P6); high-temperature stored hot water at the top of the heat collection tank (E6) enters the heating water storage tank (E7) through a lower circulating water inlet of the heating water storage tank (E7) when driven by the second water pump (P2), and low-temperature stored hot water at the bottom of the heating water storage tank (E7) enters the top of the heat collection tank (E6) through a lower circulating water outlet, so that high-grade heat energy of the heat collection tank (E6) is transferred to the heating water storage tank (E7); domestic tap water enters the second heat taking coil unit (E4) and is heated after heat exchange with stored hot water in the middle of the heating water storage tank (E7), and heated tap water is transferred to the user to meet the domestic hot water demand of users; high-temperature hot water in the first heat taking coil unit (E8) at the top of the heating water storage tank (E7) enters a pipe of the first refrigeration unit heat exchanger (E10) and is cooled down after heat exchange with the lithium bromide solution in the shell, to provide high-quality heat energy for the lithium bromide absorptive refrigeration unit; and circulating water with heat exchanged is driven by the third water pump (P3) to return to the first heat taking coil unit (E8), so that the supply of high-temperature hot water is completed.

5. The operation method according to claim 4, wherein, steps of refrigeration cycle of the ground source heat pump unit in the combined cooling mode for the ground source heat pump and the lithium bromide absorptive refrigeration unit with gas heat complementing are the same as the steps of the refrigeration cycle of the ground source heat pump unit in the combined cooling mode for the ground source heat pump and the lithium bromide absorptive refrigeration unit;

steps of refrigeration cycle of the lithium bromide absorptive refrigeration unit in the combined cooling mode for the ground source heat pump and the lithium bromide absorptive refrigeration unit with gas heat complementing are the same as the steps of the refrigeration cycle of the lithium bromide absorptive refrigeration unit in the combined cooling mode for the ground source heat pump and the lithium bromide absorptive refrigeration unit;

steps of the waste heat recovery cycle in the combined cooling mode of the ground source heat pump and the lithium bromide absorptive refrigeration unit with gas heat complementing are the same as steps of the waste heat recovery cycle in the ground source heat pump cooling mode;

steps of user-side chilled water circulation in the combined cooling mode for the ground source heat pump and the lithium bromide absorptive refrigeration unit with gas heat complementing are the same as steps of user-side chilled water circulation in the ground source heat pump cooling mode;

the high-temperature hot water supply includes the following steps:

a high-temperature refrigerant in a solar energy heat collector (E1) enters an upper heat collection coil unit (E2) and is cooled down after heat exchange with stored hot water at an upper part in the heat collection tank (E6), and then returns to the solar energy heat collector (E1) under the pressurization of the first water pump (P1); the stored hot water in the heat collection tank (E6) is heated by the upper heat collection coil unit (E2); stored hot water at a lower part of the heat collection tank (E6) enters a pipe of the fourth refrigeration unit heat exchanger (E14) when driven by the fourth water pump (P4) and is heated after heat exchange with the lithium bromide solution in a shell of the fourth refrigeration unit heat exchanger, the heated circulating water flows out from the fourth refrigeration unit heat exchanger (E14) into a pipe of the second refrigeration unit heat exchanger (E11), is heated again by a gaseous refrigerant in a shell of the second refrigeration unit heat exchanger (E11), and then the heated circulating water returns to the heat collection tank (E6); low-temperature circulating water in the lower heat collection coil unit (E25) at the bottom of the heat collection water tank (E6) enters a second pipe of the second ground source heat pump heat exchanger (E19), and is heated after heat exchange with a gaseous refrigerant in a first pipe of the second ground source heat pump heat exchanger, and the heated circulating water returns to the lower heat collection coil unit (E25) under the pressurization of the sixth water pump (P6); driven by the second water pump (P2), high-temperature stored hot water at the top of the heat collection tank (E6) enters the bottom of the heating water storage tank (E7), and low-temperature stored hot water at the bottom of the heating water storage tank (E7) enters the top of the heat collection tank (E6) through a lower circulating water outlet of the heating water storage tank (E7), so that high-grade heat energy of the heat collection tank (E6) is transferred to the heating water storage tank (E7); and circulating water at an upper part of the heating water storage tank (E7) enters the gas-fired heating and hot water combi-boiler (E20) through the heat complementing circulation pipelines under the pressurization of the seventh water pump (P7) and is heated after heat exchange with a high-temperature flue gas in the gas-fired heating and hot water combi-boiler (E20), and heated circulating water returns to the heating water storage tank (E7); domestic tap water enters the second heat taking coil unit (E4) and is heated after heat exchange with stored hot water in the middle of the heating water storage tank (E7), and heated tap water is transferred to the user to meet the domestic hot water demand of users; high-temperature hot water in the first heat taking coil unit (E8) at the top of the heating water storage tank (E7) enters a pipe of the first refrigeration unit heat exchanger (E10), to provide high-quality heat energy for the first refrigeration unit heat exchanger; circulating water after heat exchange is driven by the third water pump (P3) to be back to the first heat collection coil unit (E8), so that high-temperature hot water supply is completed.

6. The operation method according to claim 3, wherein, the heating cycle of the ground source heat pump unit includes:

the ground source heat pump unit compressor (E18) compresses a low-temperature gaseous refrigerant into a high-temperature gaseous refrigerant, the compressed refrigerant flows into a second pipe of the first ground source heat pump heat exchanger (E17), the refrigerant performs heat exchange with return water of supplied hot water from the fan coil unit (E21) and fresh air heat exchanger (E22) on the user side in the first pipe of the first ground source heat pump heat exchanger, and is then cooled down to liquefy it into a liquid refrigerant, and then the liquid refrigerant flows into the second throttle valve (E20), the liquid refrigerant expands into a gas-liquid two-phase mixed refrigerant after throttling by the second throttle valve (E20), the gas-liquid two-phase mixed refrigerant enters the first pipe of the second ground source heat pump heat exchanger (E19), is heated after absorbing, in the second ground source heat pump heat exchanger (E19), heat from circulating return water of the soil source heat exchanger (E9) in the second pipe of the heat pump heat exchanger, and the gas-liquid two-phase mixed refrigerant is heated into superheated refrigerant vapor, and the superheated refrigerant vapor returns to the ground source heat pump unit compressor (E18), so that the heating cycle of the ground source heat pump unit is completed;

the user-side heating cycle includes the following steps:

return water of supplied hot water from the fan coil unit (E21) and the fresh air heat exchanger (E22) on the user side enters a first pipe of the first ground source heat pump heat exchanger (E17) and is heated after heat exchange with a gaseous refrigerant in a second pipe of the first ground source heat pump heat exchanger, and supplied hot water flows out from the first pipe of the first ground source heat pump heat exchanger (E17), and enters, under the pressurization of the fifth water pump (P5), the fan coil unit (E21) and the fresh air heat exchanger (E22) on the user side through fan coil unit heat exchange pipelines for heat exchange, and then supplied hot water after heat exchange returns to the first pipe of the first ground source heat pump heat exchanger (E17), so that the user-side heating cycle is completed;

the domestic hot water supply includes the following steps:

a high-temperature refrigerant in a solar energy heat collector (E1) enters an upper heat collection coil unit (E2) and is cooled down after heat exchange with stored hot water at an upper part in the heat collection tank (E6), and then returns to the solar energy heat collector (E1) under the pressurization of the first water pump (P1); the stored hot water in the heat collection tank (E6) is heated by an upper heat collection coil unit (E2); driven by the second water pump (P2), the high-temperature stored hot water at the top of the heat collection tank (E6) enters the bottom of the heating water storage tank (E7), and low-temperature stored hot water at the bottom of the heating water storage tank (E7) enters the top of the heat collection tank (E6) through a lower circulating water outlet, so that high-grade heat energy of the heat collection tank (E6) is transferred to the heating water storage tank (E7); and circulating water at an upper part of the heating water storage tank (E7) enters the gas-fired heating and hot water combi-boiler (E20) under the pressurization of the seventh water pump (P7) and is heated after heat exchange with a high-temperature flue gas in the gas-fired heating and hot water combi-boiler (E20), and the heated circulating water returns to the heating water storage tank (E7); and domestic tap water enters the second heat taking coil unit (E4) and is heated after heat exchange with stored hot water in the middle of the heating water storage tank (E7), and heated tap water is transferred to the user to meet the domestic hot water demand of users, so that domestic hot water supply is completed.

7. The operation method according to claim 6, wherein, steps of heating cycle of the ground source heat pump unit in the gas heat complementing-ground source heat pump heating mode are the same as steps of the heating cycle of the ground source heat pump unit in the ground source heat pump heating mode;

the user-side heating cycle includes the following steps:

return water of supplied hot water from the fan coil unit (E21) and the fresh air heat exchanger (E22) on the user side enters a first pipe of the first ground source heat pump heat exchanger (E17) and is heated after heat exchange with a gaseous refrigerant in a second pipe of the first ground source heat pump heat exchanger, and the heated supplied hot water flows out from the first pipe of the first ground source heat pump heat exchanger (E17), enters the gas-fired heating and hot water combi-boiler (E20) through heat complementing circulation pipelines under the pressurization of the fifth water pump (P5), and is heated again after heat exchange with a high-temperature flue gas, and heated supplied hot water flows out from the gas-fired heating and hot water combi-boiler (E20) and enters the fan coil unit (E21) and the fresh air heat exchanger (E22) on the user side for heat exchange, and then the hot water after heat exchange returns to the first pipe of the first ground source heat pump heat exchanger (E17), so that the user-side heating cycle is completed;

the domestic hot water supply includes the following steps:

a high-temperature refrigerant in a solar energy heat collector (E1) enters an upper heat collection coil unit (E2) and is cooled down after heat exchange with stored hot water at an upper part in the heat collection tank (E6), and then returns to the solar energy heat collector (E1) under the pressurization of the first water pump (P1); the stored hot water in the heat collection tank is heated by the upper heat collection coil unit (E2);

driven by the second water pump (P2), high-temperature stored hot water at the top of the heat collection tank (E6) enters the bottom of the heating water storage tank (E7), and low-temperature stored hot water at the bottom of the heating water storage tank (E7) enters the top of the heat collection tank (E6) through a lower circulating water outlet, so that high-grade heat energy of the heat collection tank (E6) is transferred to the heating water storage tank (E7); and domestic tap water enters the second heat taking coil unit (E4) and is heated after heat exchange with stored hot water in the middle of the heating water storage tank (E7), and heated tap water is transferred to the user to meet the domestic hot water demand of users, so that domestic hot water supply is completed.

* * * * *